US008041243B2

(12) United States Patent
Matsushita et al.

(10) Patent No.: US 8,041,243 B2
(45) Date of Patent: Oct. 18, 2011

(54) IMAGE FORMING APPARATUS AND IMAGE FORMING METHOD CAPABLE OF EFFECTIVELY TRANSFERRING TONER IMAGES

(75) Inventors: Makoto Matsushita, Osaka (JP); Yoshie Tsuchida, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 328 days.

(21) Appl. No.: 12/344,957

(22) Filed: Dec. 29, 2008

(65) Prior Publication Data

US 2009/0180791 A1 Jul. 16, 2009

(30) Foreign Application Priority Data

Jan. 11, 2008 (JP) ..... 2008-004490

(51) Int. Cl.
*G03G 15/16* (2006.01)

(52) U.S. Cl. ..... 399/66

(58) Field of Classification Search ..... 399/26, 399/31, 66

See application file for complete search history.

(56) References Cited

U.S. PATENT DOCUMENTS

| | | | | |
|---|---|---|---|---|
| 7,319,829 | B2 * | 1/2008 | Comstock | 399/66 |
| 7,428,400 | B2 | 9/2008 | Iwakura et al. | |
| 2006/0210326 | A1 | 9/2006 | Takehara et al. | |
| 2008/0152378 | A1 | 6/2008 | Yamashita et al. | |
| 2008/0226313 | A1 | 9/2008 | Tsuchida et al. | |

FOREIGN PATENT DOCUMENTS

| | | |
|---|---|---|
| JP | 4-80777 | 3/1992 |
| JP | 2000-98771 | 4/2000 |
| JP | 2000-112264 | 4/2000 |
| JP | 3172557 | 3/2001 |
| JP | 2001-194840 | 7/2001 |
| JP | 2001-312110 | 11/2001 |
| JP | 2003-186283 | 7/2003 |
| JP | 2003-241444 | 8/2003 |
| JP | 2005-17624 | 1/2005 |
| JP | 2007-199504 | 8/2007 |

* cited by examiner

*Primary Examiner* — Hoang Ngo
(74) *Attorney, Agent, or Firm* — Oblon, Spivak, McClelland, Maier & Neustadt, L.L.P.

(57) ABSTRACT

A first degradation degree detector detects a first degradation degree of one of a plurality of image forming devices for forming toner images, respectively, which is provided at an extreme downstream position in a direction of rotation of an intermediate transfer member. A first degradation degree judgment device judges whether or not the first degradation degree of the extreme downstream image forming device detected by the first degradation degree detector reaches a first level of deterioration. A bias controller decreases a bias to be applied by a transfer device to transfer the toner images, which are formed by the plurality of image forming devices and transferred on the intermediate transfer member, onto a transfer sheet, when the first degradation degree judgment device judges that the first degradation degree of the extreme downstream image forming device detected by the first degradation degree detector reaches the first level.

9 Claims, 10 Drawing Sheets

FIG. 5

| | NUMBER OF SHEETS (/1000SHEETS) | | | | | |
|---|---|---|---|---|---|---|
| | 50 | 100 | 150 | 200 | 250 | 300 |
| WITH SECOND TRANSFER ELECTRIC CURRENT CONTROL | ○ | ○ | ○ | ○ | ○ | ○ |
| WITHOUT SECOND TRANSFER ELECTRIC CURRENT CONTROL | ○ | ○ | ○ | △ | △ | × |

○: NO PROBLEM

△: CRACKS APPEAR ON INTERMEDIATE TRANSFER BELT, BUT NOT RESULTING IN FAULTY IMAGE

×: CRACKS APPEAR ON INTERMEDIATE TRANSFER BELT, RESULTING IN FAULTY IMAGE

FIG. 6

| | MOVING DISTANCE OF DEVELOPMENT ROLLER (m) | 1000 | 2000 | 3000 | 4000 | 5000 | 6000 | 7000 | 8000 | 9000 | 10000 |
|---|---|---|---|---|---|---|---|---|---|---|---|
| CONSUMPTION AMOUNT OF TONER PARTICLES (g) | 10 | 100 | 200 | 300 | 400 | 500 | 600 | 700 | 800 | 900 | 1000 |
| | 30 | 33 | 67 | 100 | 133 | 167 | 200 | 233 | 267 | 300 | 333 |
| | 60 | 17 | 33 | 50 | 67 | 83 | 100 | 117 | 133 | 150 | 167 |
| | 90 | 11 | 22 | 33 | 44 | 56 | 67 | 78 | 89 | 100 | 111 |
| | 120 | 8 | 17 | 25 | 33 | 42 | 50 | 58 | 67 | 75 | 83 |
| | 150 | 7 | 13 | 20 | 27 | 33 | 40 | 47 | 53 | 60 | 67 |
| | 180 | 6 | 11 | 17 | 22 | 28 | 33 | 39 | 44 | 50 | 56 |
| | 210 | 5 | 10 | 14 | 19 | 24 | 29 | 33 | 38 | 43 | 48 |

FIG. 7

| | MOVING DISTANCE OF DEVELOPMENT ROLLER (m) | 1000 | 2000 | 3000 | 4000 | 5000 | 6000 | 7000 | 8000 | 9000 | 10000 |
|---|---|---|---|---|---|---|---|---|---|---|---|
| ENVIRONMENTAL CONDITION | NN (23°C/50%) : COEFFICIENT = 1.0 | 1000 | 2000 | 3000 | 4000 | 5000 | 6000 | 7000 | 8000 | 9000 | 10000 |
| | HH (32°C/60%) : COEFFICIENT = 1.2 | 1200 | 2400 | 3600 | 4800 | 6000 | 7200 | 8400 | 9600 | 10800 | 12000 |
| | LL (10°C/15%) : COEFFICIENT = 1.5 | 1500 | 3000 | 4500 | 6000 | 7500 | 9000 | 10500 | 12000 | 13500 | 15000 |

FIG. 8

| | MOVING DISTANCE OF DEVELOPMENT ROLLER (m) | 1000 | 2000 | 3000 | 4000 | 5000 | 6000 | 7000 | 8000 | 9000 | 10000 |
|---|---|---|---|---|---|---|---|---|---|---|---|
| CONSUMPTION AMOUNT OF TONER PARTICLES (g) : NN | 10 | 100 | 200 | 300 | 400 | 500 | 600 | 700 | 800 | 900 | 1000 |
| | 30 | 33 | 67 | 100 | 133 | 167 | 200 | 233 | 267 | 300 | 333 |
| | 60 | 17 | 33 | 50 | 67 | 83 | 100 | 117 | 133 | 150 | 167 |
| | 90 | 11 | 22 | 33 | 44 | 56 | 67 | 78 | 89 | 100 | 111 |
| | 120 | 8 | 17 | 25 | 33 | 42 | 50 | 58 | 67 | 75 | 83 |
| | 150 | 7 | 13 | 20 | 27 | 33 | 40 | 47 | 53 | 60 | 67 |
| | 180 | 6 | 11 | 17 | 22 | 28 | 33 | 39 | 44 | 50 | 56 |
| | 210 | 5 | 10 | 14 | 19 | 24 | 29 | 33 | 38 | 43 | 48 |
| | MOVING DISTANCE OF DEVELOPMENT ROLLER (m) | (1200) | (2400) | (3600) | (4800) | (6000) | (7200) | (8400) | (9600) | (10800) | (12000) |
| CONSUMPTION AMOUNT OF TONER PARTICLES (g) : HH | 10 | 120 | 240 | 360 | 480 | 600 | 720 | 840 | 960 | 1080 | 1200 |
| | 30 | 40 | 80 | 120 | 160 | 200 | 240 | 280 | 320 | 360 | 400 |
| | 60 | 20 | 40 | 60 | 80 | 100 | 120 | 140 | 160 | 180 | 200 |
| | 90 | 13 | 27 | 40 | 53 | 67 | 80 | 93 | 107 | 120 | 133 |
| | 120 | 10 | 20 | 30 | 40 | 50 | 60 | 70 | 80 | 90 | 100 |
| | 150 | 8 | 16 | 24 | 32 | 40 | 48 | 56 | 64 | 72 | 80 |
| | 180 | 7 | 13 | 20 | 27 | 33 | 40 | 47 | 53 | 60 | 67 |
| | 210 | 6 | 11 | 17 | 23 | 29 | 34 | 40 | 46 | 51 | 57 |
| | MOVING DISTANCE OF DEVELOPMENT ROLLER (m) | (1500) | (3000) | (4500) | (6000) | (7500) | (9000) | (10500) | (12000) | (13500) | (15000) |
| CONSUMPTION AMOUNT OF TONER PARTICLES (g) : LL | 10 | 150 | 300 | 450 | 600 | 750 | 900 | 1050 | 1200 | 1350 | 15000 |
| | 30 | 50 | 100 | 150 | 200 | 250 | 300 | 350 | 400 | 450 | 500 |
| | 60 | 25 | 50 | 75 | 100 | 125 | 150 | 175 | 200 | 225 | 250 |
| | 90 | 17 | 33 | 50 | 67 | 83 | 100 | 117 | 133 | 150 | 167 |
| | 120 | 13 | 25 | 38 | 50 | 63 | 75 | 88 | 100 | 113 | 125 |
| | 150 | 10 | 20 | 30 | 40 | 50 | 60 | 70 | 80 | 90 | 100 |
| | 180 | 8 | 17 | 25 | 33 | 42 | 50 | 58 | 67 | 75 | 83 |
| | 210 | 7 | 14 | 21 | 29 | 36 | 43 | 50 | 57 | 64 | 71 |

IMAGE FORMING APPARATUS AND IMAGE FORMING METHOD CAPABLE OF EFFECTIVELY TRANSFERRING TONER IMAGES

CROSS-REFERENCE TO RELATED APPLICATIONS

The present application is based on and claims priority to Japanese Patent Application No. 2008-004490, filed on Jan. 11, 2008 in the Japan Patent Office, the entire contents of which are hereby incorporated herein by reference.

BACKGROUND OF THE INVENTION

1. Field of the Invention

Exemplary aspects of the present invention relate to an image forming apparatus and an image forming method, and more particularly, to an image forming apparatus and an image forming method using a plurality of image forming devices for forming respective toner images.

2. Description of the Related Art

Related-art image forming apparatuses, such as copiers, facsimile machines, printers, or multifunction printers having at least one of copying, printing, scanning, and facsimile functions, typically form an image on a recording medium (e.g., a transfer sheet) based on image data using electrophotography. Thus, for example, a charger uniformly charges a surface of an image carrier; an optical writer emits a light beam onto the charged surface of the image carrier to form an electrostatic latent image on the image carrier according to the image data; a development device supplies toner particles to the electrostatic latent image formed on the image carrier to make the electrostatic latent image visible as a toner image; the toner image is directly transferred from the image carrier onto a transfer sheet in a direct transfer method or is indirectly transferred from the image carrier onto a transfer sheet via an intermediate transfer member in an indirect transfer method; a cleaner then cleans the surface of the image carrier after the toner image is transferred from the image carrier onto the transfer sheet; and finally, a fixing device applies heat and pressure to the transfer sheet bearing the toner image to fix the toner image on the transfer sheet, thus forming the image on the transfer sheet.

Such image forming apparatus may include a plurality of image forming devices, each of which includes the charger, the image carrier, the development device, and the cleaner, so as to form a color toner image on a transfer sheet. For example, the plurality of image forming devices forms toner images in respective colors and the toner images are sequentially transferred onto a transfer sheet being conveyed in such a manner that the toner images are superimposed on the transfer sheet to form a color toner image on the transfer sheet in the direct transfer method. Alternatively, the toner images formed by the plurality of image forming devices, respectively, are transferred onto a rotating intermediate transfer member sequentially in such a manner that the toner images are superimposed on the intermediate transfer member, and then the superimposed toner images are collectively transferred from the intermediate transfer member onto a transfer sheet being conveyed to form a color toner image on the transfer sheet in the indirect transfer method.

Such image forming apparatus can form a toner image properly when the image forming device is new. However, over time, a charge amount of a developer used in the image forming device decreases, resulting in formation of a low-quality solid image and a low-quality halftone image having a low toner density. Especially, the low-quality image having the low toner density may appear as a rough image.

To address this problem, a technology to set a proper transfer electric current for transferring a toner image onto a transfer sheet that varies according to a number of sheets printed is proposed. Such technology is applicable to an image forming apparatus including a single image forming device, but is not applicable to an image forming apparatus including a plurality of image forming devices. It is especially difficult to apply such technology to an image forming apparatus using the indirect transfer method, because each of the plurality of image forming devices degrades at different rates and to different degrees. Accordingly, the conditions under which the superimposed toner images are properly transferred from the intermediate transfer member onto a transfer sheet may be different for each of the toner images formed by the plurality of image forming devices and superimposed on an intermediate transfer member.

Further, toner images formed by image forming devices provided upstream in a direction of rotation of the intermediate transfer member are transferred onto the intermediate transfer member and then conveyed past other image forming devices provided downstream from the upstream image forming devices, during which time the toner images are susceptible to various physical actions performed by the other image forming devices. Accordingly, such toner images need to be transferred from the intermediate transfer member onto a transfer sheet under conditions different from the conditions for an image forming apparatus including only a single image forming device.

BRIEF SUMMARY OF THE INVENTION

This specification describes below an image forming apparatus according to an exemplary embodiment of the present invention. In one exemplary embodiment of the present invention, the image forming apparatus includes a plurality of image forming devices, an intermediate transfer member, a transfer device, a first degradation degree detector, a first degradation degree judgment device, and a bias controller.

The plurality of image forming devices is configured to form respective toner images. The rotating intermediate transfer member is configured to receive the toner images from the plurality of image forming devices. The transfer device is configured to apply a bias to the intermediate transfer member to transfer the toner images formed on the intermediate transfer member onto a transfer sheet. The first degradation degree detector is configured to detect a first degradation degree of one of the plurality of image forming devices provided at an extreme downstream position in a direction of rotation of the intermediate transfer member. The first degradation degree judgment device is configured to judge whether or not the first degradation degree of the extreme downstream image forming device detected by the first degradation degree detector reaches a first level of deterioration. The bias controller is configured to decrease the bias to be applied by the transfer device to a value smaller than a value of the bias to be applied when the first degradation degree judgment device judges that the first degradation degree of the extreme downstream image forming device detected by the first degradation degree detector does not reach the first level, when the first degradation degree judgment device judges that the first degradation degree of the extreme downstream image forming device detected by the first degradation degree detector reaches the first level.

This specification further describes below an image forming method according to an exemplary embodiment of the present invention. In one exemplary embodiment of the present invention, the image forming method includes forming respective toner images with a plurality of image forming devices, transferring the toner images formed by the plurality of image forming devices onto a rotating intermediate transfer member, and detecting a first degradation degree of one of the plurality of image forming devices provided at an extreme downstream position in a direction of rotation of the intermediate transfer member with a first degradation degree detector. The image forming method further includes judging whether or not the first degradation degree of the extreme downstream image forming device detected by the first degradation degree detector reaches a first level of deterioration with a first degradation degree judgment device. The image forming method further includes decreasing a bias to be applied by a transfer device to a value smaller than a value of the bias to be applied when the first degradation degree judgment device judges that the first degradation degree of the extreme downstream image forming device detected by the first degradation degree detector does not reach the first level, when the first degradation degree judgment device judges that the first degradation degree of the extreme downstream image forming device detected by the first degradation degree detector reaches the first level. The image forming method further includes applying the decreased bias to the intermediate transfer member with the transfer device to transfer the toner images formed on the intermediate transfer member onto a transfer sheet.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein:

FIG. 5 is a lookup table illustrating a test result showing a relation between control of a second transfer electric current and image quality;

FIG. 6 is a lookup table illustrating examples of a degradation degree of an image forming station included in the image forming apparatus shown in FIG. 1, which is obtained by dividing a driving amount of the image forming station by a consumption amount of toner particles;

FIG. 7 is a lookup table illustrating examples of a degradation degree of an image forming station included in the image forming apparatus shown in FIG. 1, which is obtained by multiplying a driving amount of the image forming station by an environmental coefficient;

FIG. 8 is a lookup table illustrating examples of a degradation degree of an image forming station included in the image forming apparatus shown in FIG. 1, which is obtained by dividing a driving amount of the image forming station by a consumption amount of toner particles and multiplying the driving amount of the image forming station by an environmental coefficient;

DETAILED DESCRIPTION OF THE INVENTION

Figure 1:
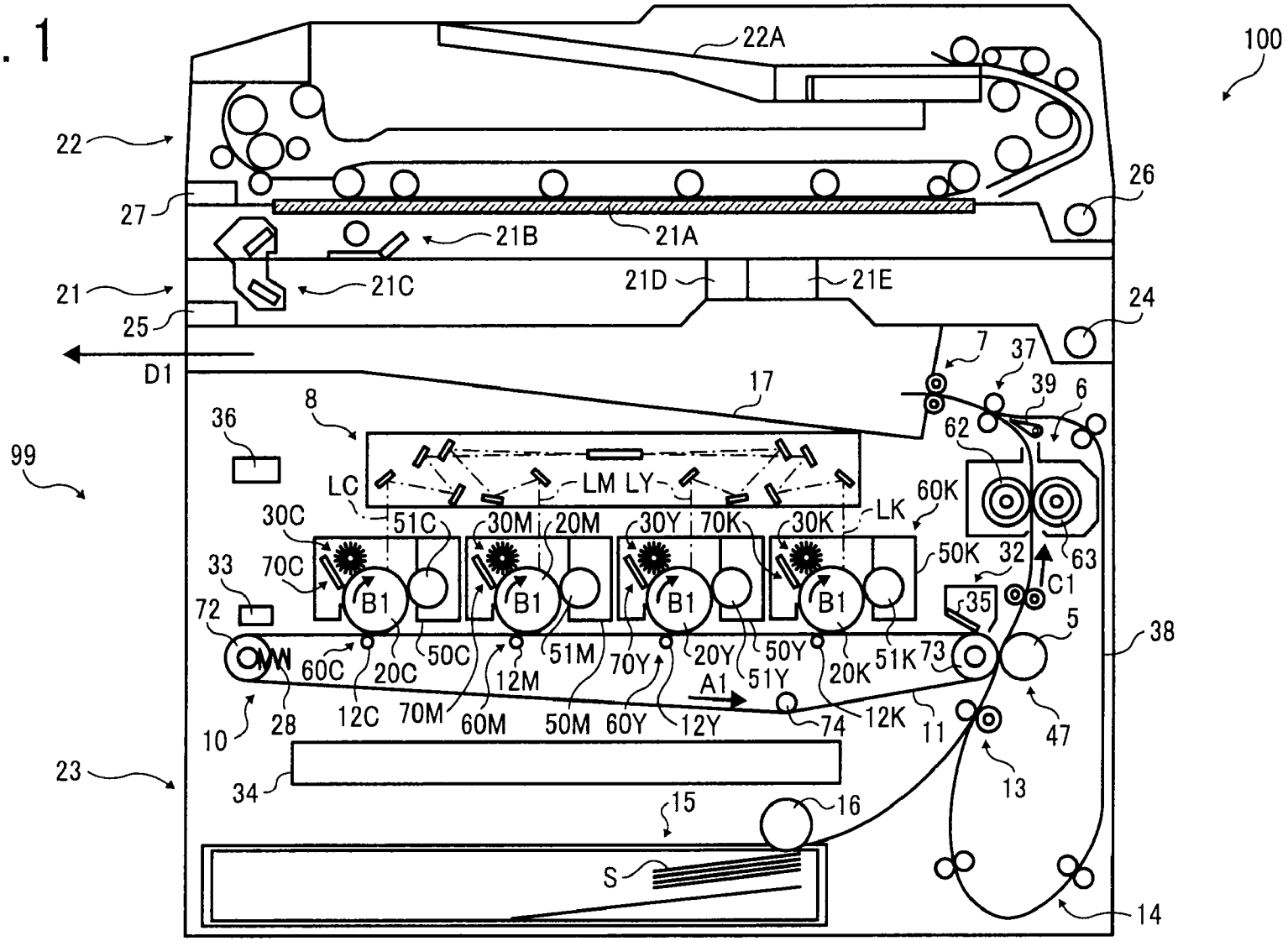
FIG. 1 is a schematic front view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 100 according to an exemplary embodiment of the present invention is explained.

As illustrated in FIG. 1, the image forming apparatus 100 includes a body 99, a reader 21, an auto document feeder (ADF) 22, a sheet supply device 23, and a reversal feeding device 14.

The body 99 includes image forming stations 60K, 60Y, 60M, and 60C, a transfer belt unit 10, a second transfer device 47, a cleaner 32, a toner mark sensor 33, an optical scanner 8, a waste toner container 34, a registration roller pair 13, a fixing device 6, an output tray 17, and an environment sensor 36. The image forming stations 60K, 60Y, 60M, and 60C include photoconductive drums 20K, 20Y, 20M, and 20C, cleaners 70K, 70Y, 70M, and 70C, chargers 30K, 30Y, 30M, and 30C, and development devices 50K, 50Y, 50M, and 50C, respectively. The development devices 50K, 50Y, 50M, and 50C include development rollers 51K, 51Y, 51M, and 51C, respectively. The transfer belt unit 10 includes an intermediate transfer belt 11, first transfer rollers 12K, 12Y, 12M, and 12C, a tension roller 72, a transfer portion entrance roller 73, a stretch roller 74, and springs 28. The second transfer device 47 includes a second transfer roller 5. The cleaner 32 includes an intermediate transfer belt cleaning blade 35. The fixing device 6 includes a fixing roller 62 and a pressing roller 63.

The reader 21 includes a shaft 24, a catch portion 25, an exposure glass 21A, a first moving body 21B, a second moving body 21C, an image forming lens 21D, and a reading sensor 21E.

The auto document feeder 22 includes a shaft 26, a catch portion 27, and an original document sheet tray 22A.

The sheet supply device 23 includes a paper tray 15 and a feeding roller 16.

The reversal feeding device 14 includes an output roller pair 7, a conveying roller pair 37, a reversal conveyance path 38, and a switcher 39.

The image forming apparatus 100 can be a copier, a facsimile machine, a printer, a plotter, a multifunction printer having at least one of copying, printing, scanning, plotter, and facsimile functions, or the like. According to this non-limiting exemplary embodiment of the present invention, the image forming apparatus 100 functions as a multifunction printer for forming a full-color image on a recording medium by electrophotography. When the image forming apparatus 100 uses the printing function or the facsimile function, the image forming apparatus 100 forms an image based on an image signal corresponding to image data sent from an external device.

The image forming apparatus 100 can form an image on a transfer material, a transfer sheet, or a recording sheet serving as a transfer medium or a recording medium, such as plain paper, an OHP (overhead projector) transparency, thick paper including a card and a postcard, and an envelope. The image forming apparatus 100 can form an image on one side of a transfer sheet S, serving as a transfer medium, or both sides of the transfer sheet S.

The image forming apparatus 100 functions as a tandem type image forming apparatus or an image forming apparatus using a tandem method, which has a tandem structure in which a plurality of image carriers or latent image carriers, that is, the photoconductive drums 20K, 20Y, 20M, and 20C, is arranged. The photoconductive drums 20K, 20Y, 20M, and 20C have a tubular shape and carry black, yellow, magenta, and cyan toner images formed from latent images corresponding to black, yellow, magenta, and cyan colors, respectively.

The photoconductive drums 20K, 20Y, 20M, and 20C have an identical diameter of about 24 mm, and are arranged with an identical gap provided between the adjacent photoconductive drums 20K, 20Y, 20M, and 20C to face an outer circumferential surface of the intermediate transfer belt 11, which carries toner images. The intermediate transfer belt 11, serving as an intermediate transfer member and having an endless belt shape, is provided in a substantially center portion inside the body 99 of the image forming apparatus 100. The intermediate transfer belt 11 opposes the photoconductive drums 20K, 20Y, 20M, and 20C and rotates in a direction of rotation A1.

The photoconductive drums 20K, 20Y, 20M, and 20C are arranged in this order from an upstream to a downstream in the direction of rotation A1 of the intermediate transfer belt 11, and are included in the image forming stations 60K, 60Y, 60M, and 60C serving as image forming devices for forming black, yellow, magenta, and cyan toner images, respectively.

The toner images, that is, visible images, formed on the photoconductive drums 20K, 20Y, 20M, and 20C, respectively, are transferred and superimposed onto the intermediate transfer belt 11 moving in the direction of rotation A1, and then transferred from the intermediate transfer belt 11 onto a transfer sheet S collectively.

The first transfer rollers 12K, 12Y, 12M, and 12C, serving as transfer chargers, are provided at opposing positions at which the first transfer rollers 12K, 12Y, 12M, and 12C oppose the photoconductive drums 20K, 20Y, 20M, and 20C, respectively, via the intermediate transfer belt 11. The first transfer rollers 12K, 12Y, 12M, and 12C apply voltages to the intermediate transfer belt 11 to transfer and superimpose the black, yellow, magenta, and cyan toner images from the photoconductive drums 20K, 20Y, 20M, and 20C onto an identical position on the intermediate transfer belt 11 while the intermediate transfer belt 11 rotates in the direction of rotation A1. Specifically, the black, yellow, magenta, and cyan toner images are transferred at transfer positions at which the photoconductive drums 20K, 20Y, 20M, and 20C oppose the intermediate transfer belt 11, respectively, at different times in this order from an upstream (e.g., the photoconductive drum 20K) to a downstream (e.g., the photoconductive drum 20C) in the direction of rotation A1 of the intermediate transfer belt 11.

Preferably, the intermediate transfer belt 11 is formed in an endless belt having a resin film shape in which a conductive material (e.g., carbon black and/or the like) is dispersed in PVDF (vinylidene fluoride), ETFE (ethylene-tetrafluoroethylene copolymer), PI (polyimide), PC (polycarbonate), TPE (thermoplastic elastomer), and/or the like. According to this exemplary embodiment, the intermediate transfer belt 11 has a single-layer structure in which carbon black is added to TPE having a tensile elastic modulus ranging from about 1,000 MPa to about 2,000 MPa, and serves as a belt member having a thickness ranging from about 100 μm to about 200 μm and a width of about 230 mm.

Preferably, the intermediate transfer belt 11 has a volume resistivity ranging from about $10^8$ Ω·cm to about $10^{11}$ Ω·cm and a surface resistivity ranging from about $10^8$ Ω·□ to about $10^{11}$ Ω·□ under an environment of a temperature of about 23 degrees centigrade and a relative humidity of about 50 percent. The volume resistivity and the surface resistivity are measured with a measurement device HirestaUP MCP-HT450 available from Mitsubishi Chemical Corporation under a condition in which a voltage of 500 V is applied for 10 seconds. When the volume resistivity and the surface resistivity exceed the above ranges, respectively, the intermediate transfer belt 11 is charged. Therefore, an image forming station among the image forming stations 60K, 60Y, 60M, and 60C, which is disposed downstream from other image forming station in the direction of rotation A1 of the intermediate transfer belt 11, needs to be applied with a higher voltage. Accordingly, it is difficult to use a single power source for the first transfer rollers 12K, 12Y, 12M, and 12C, because electric discharge generated in a transfer process, a transfer sheet separating process, and the like increases a charged potential of the surface of the intermediate transfer belt 11, making self-discharge difficult. To address this, a diselectrification device is provided for the intermediate transfer belt 11. When the volume resistivity and the surface resistivity are below the above-described ranges, respectively, the charged potential attenuates quickly to provide a benefit to diselectrification by self-discharge. However, an electric current flows in a surface direction during the transfer process, and thereby toner particles are spattered. To address this, the intermediate transfer belt 11 according to this exemplary embodiment has the volume resistivity and the surface resistivity of the above-described ranges, respectively.

In the image forming apparatus 100, the body 99 is provided in a center portion in a vertical direction. The reader 21, serving as a scanner, is provided above the body 99 and scans an image on an original document sheet. The auto document feeder 22 is provided above the reader 21 and feeds original document sheets loaded on the auto document feeder 22 one by one toward the reader 21. The sheet supply device 23 is provided under the body 99 and includes the paper tray 15 for loading transfer sheets S to be conveyed toward a second transfer portion formed between the intermediate transfer belt 11 and the second transfer device 47.

The transfer belt unit 10, serving as an intermediate transfer device or an intermediate transfer unit including the intermediate transfer belt 11, is provided under the four image forming stations 60K, 60Y, 60M, and 60C including the photoconductive drums 20K, 20Y, 20M, and 20C, respectively, in such a manner that the transfer belt unit 10 opposes the image forming stations 60K, 60Y, 60M, and 60C. The second transfer device 47 serves as a transfer device or a second transfer device for transferring a toner image carried on the intermediate transfer belt 11 onto a transfer sheet S.

The cleaner 32 is provided between the second transfer device 47 and the image forming station 60K in the direction of rotation A1 of the intermediate transfer belt 11 to oppose the intermediate transfer belt 11. The cleaner 32 serves as an intermediate transfer belt cleaner or an intermediate transfer belt cleaning unit for cleaning the outer circumferential surface of the intermediate transfer belt 11. The toner mark sensor 33 is provided downstream from the image forming station 60C in the direction of rotation A1 of the intermediate transfer belt 11 to oppose the outer circumferential surface of the intermediate transfer belt 11.

The optical scanner 8 is provided above the image forming stations 60C, 60M, 60Y, and 60K to oppose the image forming stations 60C, 60M, 60Y, and 60K. The optical scanner 8 serves as a writer, an optical writer, or a latent image forming device. The waste toner container 34 is provided under the transfer belt unit 10 to oppose the transfer belt unit 10, and receives waste toner removed by the cleaner 32 from the surface of the intermediate transfer belt 11. A toner conveyance path connects the cleaner 32 to the waste toner container 34.

The registration roller pair 13 feeds a transfer sheet S sent from the sheet supply device 23 toward the second transfer portion formed between the intermediate transfer belt 11 and the second transfer device 47 at a predetermined time corresponding to a time at which the image forming stations 60K, 60Y, 60M, and 60C form toner images, respectively. A sensor detects a leading edge of the transfer sheet S reaching the registration roller pair 13.

The toner images formed by the image forming stations 60K, 60Y, 60M, and 60C, respectively, are transferred and superimposed onto the intermediate transfer belt 11. The second transfer device 47 transfers the toner images superimposed on the intermediate transfer belt 11 onto the transfer sheet S fed by the registration roller pair 13 to form a color toner image on the transfer sheet S. The transfer sheet S bearing the color toner image moves in a direction C1 to enter the fixing device 6. The fixing device 6 serves as a fixing unit using a roller fixing method for fixing the color toner image on the transfer sheet S. The output roller pair 7 outputs the transfer sheet S bearing the fixed color toner image to an outside of the body 99. The environment sensor 36 is provided inside the body 99 to detect a condition of an environment in which the image forming apparatus 100 is located. The reversal feeding device 14 reverses the transfer sheet S, which has passed through the fixing device 6 and is formed with the color toner image on one side of the transfer sheet S, and feeds the transfer sheet S toward the registration roller pair 13.

The output tray 17 is provided on top of the body 99 and serves as an output portion for receiving the transfer sheet S output by the output roller pair 7 toward the outside of the body 99. The image forming apparatus 100 further includes toner bottles for containing black, yellow, magenta, and cyan toners, respectively.

Figure 2:
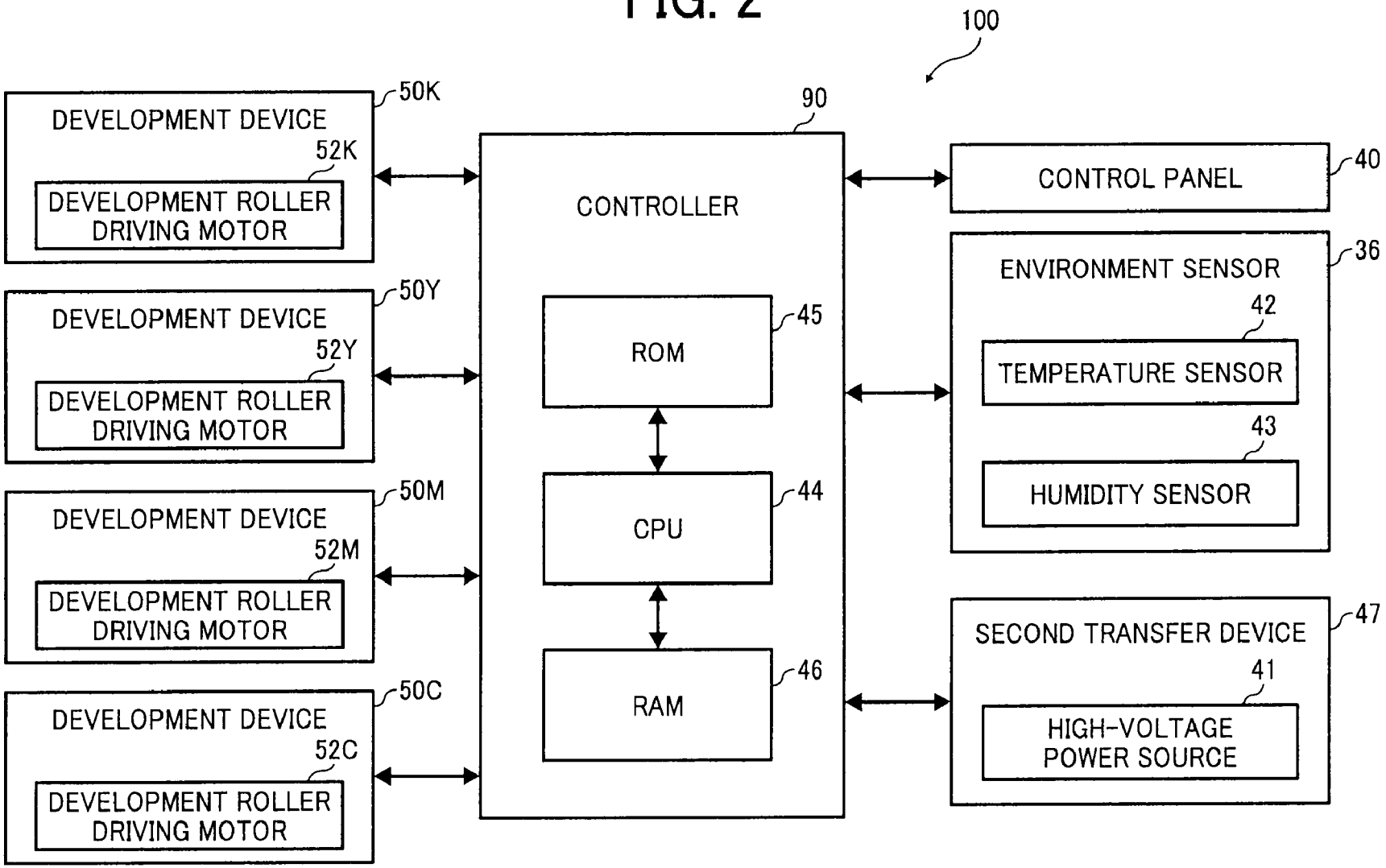
FIG. 2 is a block diagram of the image forming apparatus shown in FIG. 1.

FIG. 2 is a block diagram of the image forming apparatus 100. The image forming apparatus 100 further includes a control panel 40 and a controller 90. The controller 90 includes a ROM (read-only memory) 45, a CPU (central processing unit) 44, and a RAM (random access memory) 46. The second transfer device 47 includes a high-voltage power source 41. The development devices 50K, 50Y, 50M, and 50C include development roller driving motors 52K, 52Y, 52M, and 52C, respectively. The environment sensor 36 includes a temperature sensor 42 and a humidity sensor 43.

An operator, such as a user, operates the image forming apparatus 100 using the control panel 40. The controller 90 controls operations of the entire image forming apparatus 100.

As illustrated in FIG. 1, the image forming apparatus 100 serves as an internal output type image forming apparatus in which the output tray 17 is provided above the body 99 and under the reader 21. The user picks up the transfer sheet S output on the output tray 17 from a downstream (e.g., left in FIG. 1) of the output tray 17 in a direction D1.

The intermediate transfer belt 11 is looped over the tension roller 72, the transfer portion entrance roller 73, and the stretch roller 74. The transfer portion entrance roller 73 serves as a driving roller and a second transfer portion opposing roller. The stretch roller 74 serves as a driven roller. The springs 28 apply a force to the tension roller 72 in a direction to separate the tension roller 72 from the transfer portion entrance roller 73. A pair of intermediate transfer unit side plates rotatably supports the rollers over which the intermediate transfer belt 11 is looped, that is, the tension roller 72, the transfer portion entrance roller 73, and the stretch roller 74, at both ends of the rollers in an axial direction of the rollers in such a manner that the pair of intermediate transfer unit side plates sandwiches the intermediate transfer belt 11.

The tension roller 72 is formed of an aluminum pipe having a diameter of about 20 mm. Collars having a diameter of about 24 mm are pressingly inserted into both ends of the tension roller 72 in an axial direction of the tension roller 72. The collars serve as regulating members for regulating meandering of the intermediate transfer belt 11.

The springs 28 are provided on the intermediate transfer unit side plates, respectively, to apply a force to both ends of the tension roller 72 in the axial direction of the tension roller 72 to provide a predetermined tension to the intermediate transfer belt 11.

The transfer portion entrance roller 73 has a thickness of about 0.05 mm and a diameter of about 20 mm, and serves as a urethane-coated roller of which diameter is not easily changed by temperature. Alternatively, the transfer portion entrance roller 73 may be a polyurethane rubber roller having a thickness ranging from about 0.3 mm to about 1.0 mm. Yet alternatively, the transfer portion entrance roller 73 may be a thin-layer-coated roller having a thickness ranging from about 0.03 mm to about 0.1 mm. A motor, serving as a driver, drives and rotates the transfer portion entrance roller 73, and the rotating transfer portion entrance roller 73 rotates the intermediate transfer belt 11 in the direction of rotation A1.

Each of the first transfer rollers 12K, 12Y, 12M, and 12C serves as a metal roller having a diameter of about 8 mm. The first transfer rollers 12K, 12Y, 12M, and 12C are offset by about 8 mm toward a downstream in the direction of rotation A1 of the intermediate transfer belt 11 with respect to the photoconductive drums 20K, 20Y, 20M, and 20C, and by about 1 mm upward, respectively. Alternatively, each of the first transfer rollers 12K, 12Y, 12M, and 12C may include a conductive blade, a conductive sponge roller, and the like.

Figure 3:
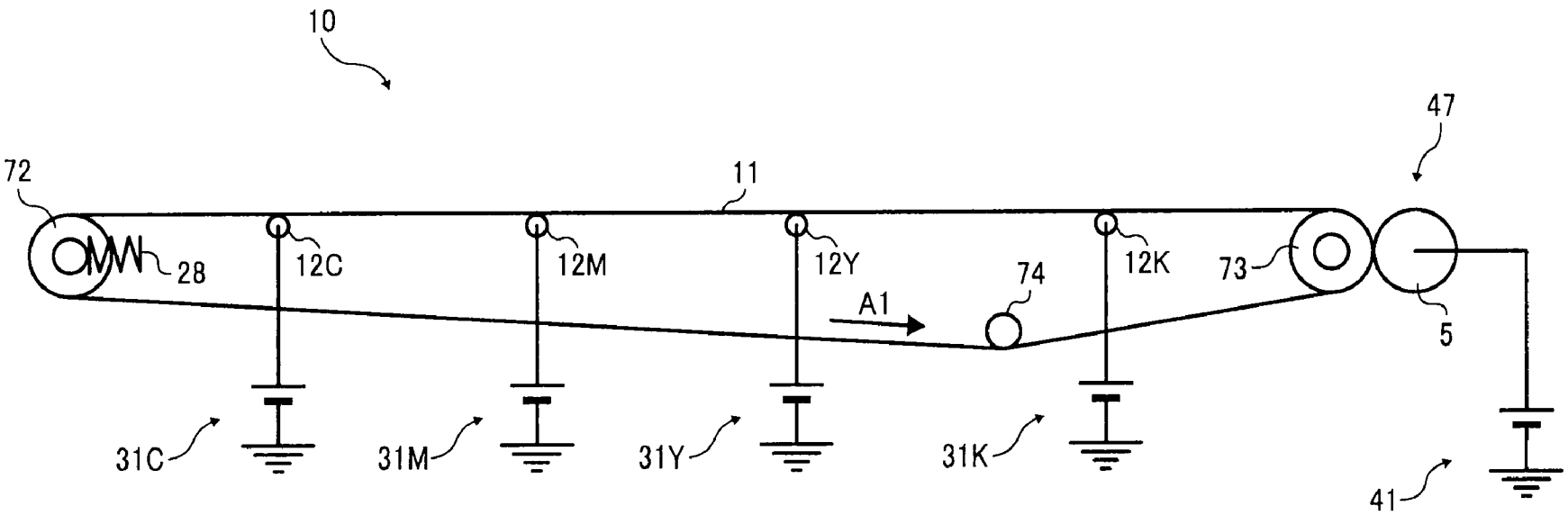
FIG. 3 is a schematic front view of a transfer belt unit and a second transfer device included in the image forming apparatus shown in FIG. 1.

FIG. 3 is a schematic front view of the transfer belt unit 10 and the second transfer device 47. The transfer belt unit 10 further includes high-voltage power sources 31K, 31Y, 31M, and 31C. The first transfer rollers 12K, 12Y, 12M, and 12C are connected to the high-voltage power sources 31K, 31Y, 31M, and 31C, respectively. The first transfer rollers 12K, 12Y, 12M, and 12C apply a transfer bias ranging from about +500 V to about +1,000 V to the photoconductive drums 20K, 20Y, 20M, and 20C depicted in FIG. 1, respectively, to transfer toner images formed on the photoconductive drums 20K, 20Y, 20M, and 20C onto the intermediate transfer belt 11.

The second transfer roller 5 opposes the transfer portion entrance roller 73 and contacts the intermediate transfer belt 11. The second transfer roller 5 serves as a transfer member or a second transfer portion opposing roller for being rotated by the rotating intermediate transfer belt 11 at a contact position at which the second transfer roller 5 contacts the intermediate transfer belt 11. The high-voltage power source 41 is connected to the second transfer roller 5 and applies a second transfer bias to the intermediate transfer belt 11 to transfer the toner images superimposed on the intermediate transfer belt 11 onto a transfer sheet S. The controller 90 depicted in FIG. 2 controls a value of the second transfer bias to be applied by the high-voltage power source 41.

The second transfer roller 5 opposes the transfer portion entrance roller 73 via the intermediate transfer belt 11 to form the second transfer portion between the intermediate transfer belt 11 and the second transfer roller 5. In the second transfer roller 5, an elastic body, including urethane and being adjusted to have a resistance ranging from about $10^6\Omega$ to about $10^{10}\Omega$ by a conductive material, covers a metal core including SUS, so that the second transfer roller 5 has a diameter of about 20 mm and an Asker C hardness ranging from about 35 degrees to about 50 degrees. Alternatively, the second transfer roller 5 may be an ion-conductive roller including urethane in which carbon is dispersed, NBR (nitrile-butadiene rubber), and/or hydrin, an electron-conductive roller including EPDM (ethylene propylene diene monomer), and/or the like. Yet alternatively, the elastic body may include other material.

When the resistance of the second transfer roller 5 exceeds an upper limit of the range from about $10^6\Omega$ to about $10^{10}\Omega$, an electric current does not flow easily, and thereby a high voltage needs to be applied to obtain a proper transfer property, resulting in increased costs of the high-voltage power source 41. Further, electric discharge generates in a gap provided upstream and downstream from the second transfer portion (e.g., a nip) formed between the intermediate transfer belt 11 and the second transfer roller 5 because a high voltage is applied. The electric discharge may generate white spots on a halftone image, especially under an environment of low temperature (e.g., 10 degrees centigrade) and low humidity (e.g., a relative humidity of 15 percent).

When the resistance of the second transfer roller 5 is below a lower limit of the range from about $10^6\Omega$ to about $10^{10}\Omega$, a proper transfer property cannot be provided on both a multicolor image portion (e.g., superimposed toner images in three colors) and a monochrome image portion on an identical image. Specifically, when the resistance of the second transfer roller 5 is low, a sufficient voltage flows to transfer the monochrome image portion with a relative low voltage. However, a higher voltage than the proper voltage for the monochrome image portion is needed to transfer the multicolor image portion. Therefore, when a voltage is adjusted for the multicolor image portion, the monochrome image portion may receive an excessive amount of transfer electric currents, resulting in a decreased transfer efficiency.

To measure the resistance of the second transfer roller 5, the second transfer roller 5 is provided on a conductive metal plate and a load of 4.9 N is applied to each of both ends of the core of the second transfer roller 5. A voltage of 1 kV is applied between the core and the conductive metal plate to calculate the resistance of the second transfer roller 5 based on a value of electric currents flown.

As illustrated in FIG. 1, the intermediate transfer belt cleaning blade 35 contacts the intermediate transfer belt 11 at an opposing position at which the intermediate transfer belt cleaning blade 35 opposes the intermediate transfer belt 11. The intermediate transfer belt cleaning blade 35 scrapes foreign substances, such as residual toner particles remaining after the toner images are transferred from the intermediate transfer belt 11 to the transfer sheet S and paper dust, to clean the intermediate transfer belt 11.

The intermediate transfer belt cleaning blade 35 includes a urethane rubber blade having a thickness ranging from about 1.5 mm to about 3.0 mm and a rubber hardness ranging from about 65 degrees to about 80 degrees. The intermediate transfer belt cleaning blade 35 counter-contacts the intermediate transfer belt 11. The foreign substances, such as residual toner particles, scraped by the intermediate transfer belt cleaning blade 35 pass through the toner conveyance path and are conveyed to the waste toner container 34 provided for the intermediate transfer belt 11. When the intermediate transfer belt cleaning blade 35 is assembled, a lubricant and/or an application agent, such as toner and zinc stearate, is applied to at least one of a portion of the intermediate transfer belt 11 forming a cleaning nip at which the intermediate transfer belt cleaning blade 35 contacts the intermediate transfer belt 11 and an edge of the intermediate transfer belt cleaning blade 35. Accordingly, the intermediate transfer belt cleaning blade 35 may not be curled at the cleaning nip. Further, a dam layer is formed at the cleaning nip to provide an improved cleaning performance.

The toner mark sensor 33 serves as a TM sensor for measuring a toner density of a toner image on the intermediate transfer belt 11 and positions of toner images in respective colors on the intermediate transfer belt 11 to adjust image density and color matching.

In the fixing device 6, a heat source is provided inside the fixing roller 62. The pressing roller 63 pressingly contacts the fixing roller 62. When a transfer sheet S bearing a color toner image passes through a fixing portion, serving as a fixing nip and a press-contact portion at which the pressing roller 63 pressingly contacts the fixing roller 62, the fixing roller 62 and the pressing roller 63 apply heat and pressure to the transfer sheet S bearing the color toner image to fix the color toner image on the transfer sheet S.

The fixing device 6 changes a process speed for fixing, that is, a rotation speed of the fixing roller 62 and the pressing roller 63 according to type of a transfer sheet S. For example, when the transfer sheet S has a basis weight not smaller than 100 $g/m^2$, the process speed is reduced by half. Thus, the transfer sheet S passes through the fixing portion for a time period twice as long as a normal time period to provide a proper fixing property.

The optical scanner 8 serves as a laser beam scanner using laser diode as a light source. The optical scanner 8 scans and exposes scan surfaces formed of surfaces of the photoconductive drums 20K, 20Y, 20M, and 20C to generate laser beams LK, LY, LM, and LC based on image signals for forming electrostatic latent images, respectively. Alternatively, the optical scanner 8 may use LED (light-emitting diode) as a light source.

The optical scanner 8 is detachably attached to the body 99. When the optical scanner 8 is detached from the body 99, process cartridges included in the image forming stations 60K, 60Y, 60M, and 60C, respectively, are detached upward from the body 99 independently.

In the sheet supply device 23, the paper tray 15 loads transfer sheets S. The feeding roller 16 serves as a feed-convey roller for feeding the transfer sheets S loaded on the paper tray 15 one by one.

The reader 21 is provided above the body 99. The shaft 24 provided in an upstream end in the direction D1, that is, one side of the image forming apparatus 100 rotatably integrates the reader 21 with the body 99. In other words, the reader 21 serves as a first open-close body openable from and closeable to the body 99.

The catch portion 25 is provided in a downstream end in the direction D1, and serves as a first catch portion for being caught by the user to lift the reader 21 with respect to the body 99. The reader 21 is rotatable about the shaft 24. When the user catches the catch portion 25 and lifts the reader 21 upward, the reader 21 is opened with respect to the body 99. For example, the reader 21 is opened at an open angle of about 90 degrees with respect to the body 99. Thus, the user can easily access an inside of the body 99 and then close the reader 21.

In the reader 21, an original document sheet is placed on the exposure glass 21A. A light source emits light onto the original document sheet placed on the exposure glass 21A. The first moving body 21B includes a first reflection body for reflecting the light reflected by the original document sheet, and moves leftward and rightward in FIG. 1. The second moving body 21C includes a second reflection body for reflecting the light reflected by the first reflection body of the first moving body 21B. The image forming lens 21D forms the light reflected by the second moving body 21C into an image. The reading sensor 21E receives the light passing through the image forming lens 21D and reads an image on the original document sheet.

The auto document feeder 22 is provided above the reader 21. The shaft 26, which is provided in an upstream end in the direction D1, that is, one side of the image forming apparatus 100, rotatably integrates the auto document feeder 22 with the reader 21. In other words, the auto document feeder 22 serves as a second open-close body openable from and closeable to the reader 21.

The catch portion 27 is provided in a downstream end in the direction D1, and serves as a second catch portion for being caught by the user to lift the auto document feeder 22 with respect to the reader 21. The auto document feeder 22 is rotatable about the shaft 26. When the user catches the catch portion 27 and lifts the auto document feeder 22 upward, the auto document feeder 22 is opened with respect to the reader 21 to expose the exposure glass 21A.

In the auto document feeder 22, an original document sheet is placed on the original document sheet tray 22A. A driver including a motor feeds the original document sheet placed on the original document sheet tray 22A. To perform a copying operation using the image forming apparatus 100, the user sets an original document sheet on the original document sheet tray 22A of the auto document feeder 22. Alternatively, the user lifts (e.g., rotates upward) the auto document feeder 22 to manually place an original document sheet on the exposure glass 21A, and then lowers the auto document feeder 22 to cause the auto document feeder 22 to press the original document sheet against the exposure glass 21A. The auto document feeder 22 is opened at an angle of about 90 degrees with respect to the reader 21. Thus, the user can easily place the original document sheet on the exposure glass 21A and perform maintenance on the exposure glass 21A.

The controller 90 depicted in FIG. 2 rotates the output roller pair 7 forward and backward. In the reversal feeding device 14, the conveying roller pair 37 is provided between the output roller pair 7 and the fixing device 6, and is controlled by the controller 90 to rotate forward and backward in synchronism with the output roller pair 7. The reversal conveyance path 38 conveys a transfer sheet S from the conveying roller pair 37 toward the registration roller pair 13 without passing through the fixing device 6 to reverse the transfer sheet S. The switcher 39 guides the transfer sheet S toward the reversal conveyance path 38 when the output roller pair 7 and the conveying roller pair 37 rotate backward.

To perform single-sided printing, the switcher 39 guides a transfer sheet S having passed through the fixing device 6 and thereby bearing a fixed toner image on one side of the transfer sheet S toward the conveying roller pair 37, and the conveying roller pair 37 and the output roller pair 7 rotate forward to feed the transfer sheet S onto the output tray 17.

To perform double-sided printing, when a trailing edge of a transfer sheet S formed with a fixed toner image on one side of the transfer sheet S passes through the switcher 39, the conveying roller pair 37 and the output roller pair 7 rotate backward and the switcher 39 moves to guide the transfer sheet S to the reversal conveyance path 38. The reversal conveyance path 38 reverses the transfer sheet S and feeds the transfer sheet S toward the registration roller pair 13.

When the transfer sheet S having passed through the reversal conveyance path 38 is conveyed toward the fixing device 6, the other side of the transfer sheet S not bearing the fixed toner image faces the intermediate transfer belt 11. Thus, the image forming apparatus 100 including the reversal feeding device 14 can form an image on both sides of the transfer sheet S.

Referring to FIGS. 1 and 2, the following describes a structure of the image forming station 60K including the photoconductive drum 20K. The image forming stations 60Y, 60M, and 60C have structures identical to the structure of the image forming station 60K, respectively, and thereby descriptions of the structures of the image forming stations 60Y, 60M, and 60C are omitted.

In the image forming station 60K, the photoconductive drum 20K rotates clockwise in FIG. 1 in a direction of rotation B1. The first transfer roller 12K of the transfer belt unit 10, the cleaner 70K, the charger 30K, and the development device 50K surround the photoconductive drum 20K. The cleaner 70K cleans the photoconductive drum 20K. The charger 30K serves as a charging device for charging the photoconductive drum 20K with a high voltage. The development device 50K develops an electrostatic latent image formed on the photoconductive drum 20K.

The photoconductive drum 20K, the cleaner 70K, the charger 30K, and the development device 50K are integrated into a process cartridge detachably attached to the body 99. The process cartridge can be handled as a replaceable part, providing an improved maintenance.

The photoconductive drum 20K rotates at a circumferential speed of about 120 mm/s. The charger 30K includes a brush roller and a high-voltage power source for applying a bias to the brush roller. The brush roller pressingly contacts a surface of the photoconductive drum 20K and is rotated by the rotating photoconductive drum 20K. The high-voltage power source applies a bias in which an alternating current is superimposed on a direct current to the brush roller. Alternatively, the high-voltage power source may apply a direct current bias. The charger 30K uniformly charges the surface of the photoconductive drum 20K at about −500 V.

In the development device 50K, the development roller 51K is provided at an opposing position at which the development roller 51K opposes the photoconductive drum 20K. The development roller driving motor 52K depicted in FIG. 2 serves as a driving source for driving and rotating the development roller 51K. A high-voltage power source applies a development bias to the development roller 51K.

The development roller 51K has a diameter of about 12 mm, and is driven and rotated by the development roller driving motor 52K at a linear speed of about 160 mm/s. The controller 90 depicted in FIG. 2 controls driving of the development roller driving motor 52K. The development device 50K performs development by contacting the photoconductive drum 20K with a one-component developer containing toner particles charged with a negative polarity as a normal charging property. In an initial state, that is, when the development device 50K is new, the development device 50K contains the toner particles in an amount of about 180 g.

As illustrated in FIG. 2, the environment sensor 36 includes the temperature sensor 42 serving as a temperature detection device for detecting a temperature at which the image forming apparatus 100 is used and the humidity sensor 43 serving as a humidity detection device for detecting a humidity at which the image forming apparatus 100 is used.

The control panel 40 includes a single-sided print key for commanding image formation on one side of a transfer sheet S by the image forming apparatus 100, a double-sided print key for commanding image formation on both sides of a transfer sheet S by the image forming apparatus 100, numeric keys for specifying a number of transfer sheets S onto which image formation is performed, and a print start key for commanding starting image formation.

In the controller 90, the ROM 45 serves as a first memory for storing operating programs of the image forming apparatus 100 and various data needed to operate the operating programs of the image forming apparatus 100. The RAM 46 serves as a second memory for storing data needed for operations of the image forming apparatus 100. The RAM 46 also serves as a temperature memory for storing a temperature detected by the temperature sensor 42 and as a humidity memory for storing a humidity detected by the humidity sensor 43.

Referring to FIGS. 1 and 2, the following describes an image forming operation for forming a full-color image using the image forming apparatus 100 having the above-described structure.

When a user presses the print start key on the control panel 40, the charger 30K uniformly charges the surface of the photoconductive drum 20K rotating in the direction of rotation B1. The optical scanner 8 emits a laser beam LK onto the charged surface of the photoconductive drum 20K in such a manner that the laser beam LK scans and exposes the surface of the photoconductive drum 20K, so as to form an electrostatic latent image according to image data corresponding to black color. For example, when the laser beam LK scans in a main scanning direction while the photoconductive drum 20K rotates in the direction of rotation B1, the laser beam LK also scans in a sub-scanning direction, that is, a circumferential direction of the photoconductive drum 20K. Thus, an electrostatic latent image is formed on the photoconductive drum 20K.

The development device 50K supplies charged black toner particles to the electrostatic latent image formed on the photoconductive drum 20K so that the toner particles are adhered to the electrostatic latent image. Accordingly, the electrostatic latent image is developed as a visual black toner image. The first transfer roller 12K first-transfers the visual black toner image onto the intermediate transfer belt 11 rotating in the direction of rotation A1. The cleaner 70K scrapes and removes foreign substances such as residual toner particles not transferred and thereby remaining on the photoconductive drum 20K from the photoconductive drum 20K. Thus, the photoconductive drum 20K becomes ready for a next charging to be performed by the charger 30K.

Similarly, yellow, magenta, and cyan toner images are formed on the photoconductive drums 20Y, 20M, and 20C, respectively, and are sequentially first-transferred by the first transfer rollers 12Y, 12M, and 12C onto the intermediate transfer belt 11 rotating in the direction of rotation A1 in such a manner that the yellow, magenta, and cyan toner images are superimposed on an identical position on the intermediate transfer belt 11, to which the black toner image is transferred.

The intermediate transfer belt 11 rotating in the direction of rotation A1 conveys the toner images superimposed on the intermediate transfer belt 11 to the second transfer portion formed between the intermediate transfer belt 11 and the second transfer device 47, at which the intermediate transfer belt 11 opposes the second transfer roller 5. The controller 90 causes the high-voltage power source 41 to apply a predetermined second transfer bias to the second transfer roller 5. Thus, the superimposed toner images on the intermediate transfer belt 11 are second-transferred onto a transfer sheet S at the second transfer portion.

The transfer sheet S conveyed to the second transfer portion formed between the intermediate transfer belt 11 and the second transfer roller 5 is fed from the sheet supply device 23. The registration roller pair 13 feeds the transfer sheet S toward the second transfer portion based on a detection signal output by a sensor at a proper time when a leading edge of the superimposed toner images on the intermediate transfer belt 11 opposes the second transfer roller 5.

When the superimposed toner images on the intermediate transfer belt 11 are collectively transferred onto the transfer sheet S and thereby the transfer sheet S carries a color toner image, the transfer sheet S is separated from the intermediate transfer belt 11 by a curvature of the transfer portion entrance roller 73, and is conveyed in the direction C1 to enter the fixing device 6. When the transfer sheet S passes through the fixing portion formed between the fixing roller 62 and the pressing roller 63, the fixing roller 62 and the pressing roller 63 apply heat and pressure to the transfer sheet S bearing the color toner image to fix the color toner image on the transfer sheet S. Thus, a fixed full-color toner image is formed on the transfer sheet S.

When the user has pressed the single-sided print key on the control panel 40, the transfer sheet S having passed through the fixing device 6 and thereby bearing the fixed full-color toner image passes through the output roller pair 7, and is stacked on the output tray 17.

When the user has pressed the double-sided print key on the control panel 40, the transfer sheet S having passed through the fixing device 6 and thereby bearing the fixed full-color toner image passes through the reversal feeding device 14, and receives toner images transferred from the intermediate transfer belt 11 on the other side of the transfer sheet S. Then, the transfer sheet S passes through the fixing device 6 and the output roller pair 7, and is stacked on the output tray 17.

Whenever a second-transfer is performed, the cleaner 32 cleans the intermediate transfer belt 11 so that the intermediate transfer belt 11 becomes ready for a next first-transfer.

When the image forming stations 60K, 60Y, 60M, and 60C are new, a high-quality toner image is formed properly. However, when the image forming stations 60K, 60Y, 60M, and 60C degrade over time, a charge amount of a developer used in the image forming stations 60K, 60Y, 60M, and 60C is decreased, deteriorating image quality of a solid image and a low-density image such as a halftone image. The deteriorated image quality of the low-density image may appear as a rough image.

The deteriorated image quality of the low-density image may easily generate on toner images transferred onto the intermediate transfer belt 11 in latter orders. Toner particles forming the toner images transferred in the latter orders tend to have a charge amount smaller than a charge amount of toner particles forming toner images transferred in former orders. The toner particles having the smaller charge amount may not provide a sufficient attraction force for being electrostatically attracted to the transfer sheet S. Further, a small amount of electric currents flows when the toner particles move, and thereby the toner particles may easily discharge electricity.

The toner particles forming the toner images transferred onto the intermediate transfer belt 11 in the latter orders tend to have a charge amount smaller than a charge amount of the toner particles forming the toner images transferred onto the intermediate transfer belt 11 in the former orders, because the toner images transferred in the former orders pass through an increased number of other image forming stations among the image forming stations 60K, 60Y, 60M, and 60C compared to the toner images transferred in the latter orders. Thus, even when the toner particles forming the toner images transferred in the former orders have a small charge amount, charging by the increased number of other image forming stations, through which the toner images transferred in the former orders pass, increases the charge amount of the toner particles forming the toner images transferred in the former orders.

By contrast, the toner particles forming the toner images transferred in the latter orders pass through a decreased number of other image forming stations. Accordingly, charging by the decreased number of other image forming stations, through which the toner images transferred in the latter orders pass, may not increase the charge amount of the toner particles forming the toner images transferred in the latter orders.

As a condition for providing high quality to the toner images transferred in the latter orders, a second transfer bias can be decreased to a level lower than an initial level, that is, a level before the toner particles forming the toner images transferred in the latter orders have a decreased charge amount, when the toner particles forming the toner images transferred in the latter orders have the decreased charge amount over time.

Figure 4A:
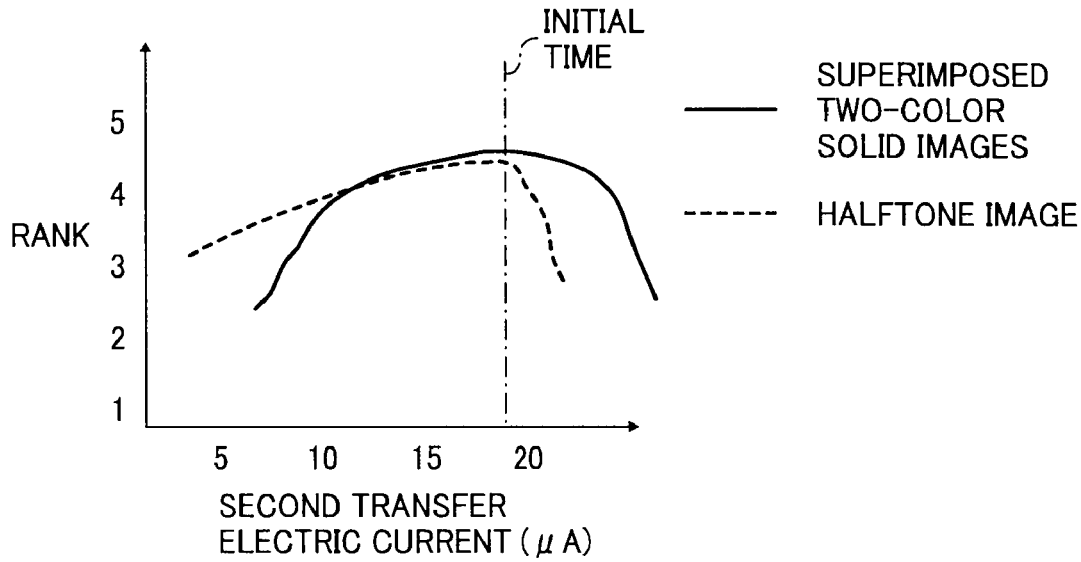
FIG. 4A is a graph illustrating a relation between a second transfer electric current and a rank indicating roughness of a toner image formed by an image forming station included in the image forming apparatus shown in FIG. 1.
Figure 4B:
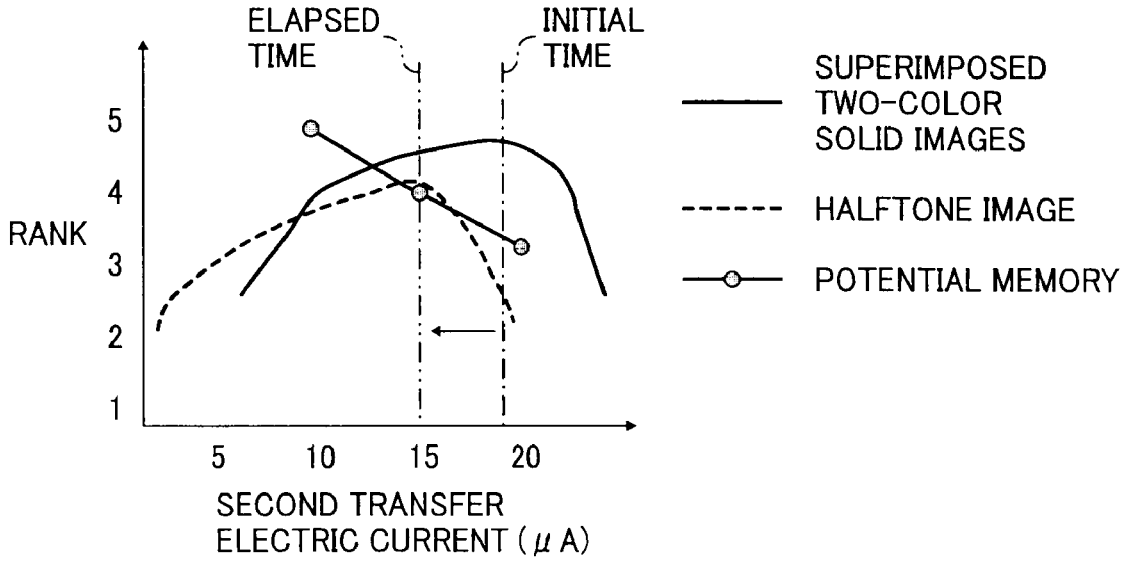
FIG. 4B is another graph illustrating a relation between a second transfer electric current and a rank indicating roughness of a toner image formed by an image forming station included in the image forming apparatus shown in FIG. 1.

Referring to FIGS. 4A and 4B, the following describes a reason why the decreased second transfer bias can provide high image quality. FIGS. 4A and 4B illustrate a graph showing a relation between a second transfer electric current and a rank indicating roughness of superimposed two-color solid images, which are formed by superimposing a solid toner image in one color on a solid toner image in other color, and roughness of a halftone image when an identical second transfer bias is applied at an initial time and at an elapsed time when a predetermined time period is elapsed after the initial time. The greater the rank is, the better the image quality is.

As illustrated in FIGS. 4A and 4B, the superimposed two-color solid images provide an almost identical rank of roughness both at the initial time and the elapsed time even when the second transfer electric current is changed. However, the halftone image provides a peak rank when a smaller second transfer electric current is applied at the elapsed time. Namely, when the predetermined time period elapses after the initial time, the halftone image provides a favorable rank when a smaller second transfer electric current is applied. In other words, when toner particles forming the halftone image have a decreased charge amount, application of a second transfer electric current smaller than an electric current applied at the initial time can suppress roughness of the halftone image. This is especially applicable to a toner image formed on a thin transfer sheet S and a toner image formed on the other side of a transfer sheet S.

As illustrated in FIG. 4B, the smaller second transfer electric current applied at the elapsed time, which suppresses roughness of the halftone image, can also suppress roughness of the superimposed two-color solid images. Therefore, the smaller second transfer electric current can provide high quality to both the halftone image and the superimposed two-color solid images.

Further, as illustrated in FIG. 4B, the smaller second transfer electric current is effective for suppression of deteriorated image quality due to a potential memory, that is, a factor of deteriorated image quality caused by a state in which a second transfer bias charges the intermediate transfer belt 11.

FIG. 5 is a lookup table illustrating a test result showing a relation between control of a second transfer electric current and image quality. As shown in the test result, the smaller second transfer bias can suppress degradation of the intermediate transfer belt 11 depicted in FIG. 1, because the decreased second transfer bias suppresses damage to the intermediate transfer belt 11 due to electric discharge.

The test was performed with process cartridges to perform duplex printing on 5,000 sheets, which serve as the image forming stations 60K, 60Y, 60M, and 60C depicted in FIG. 1, respectively. A degradation degree of each of the image forming stations 60K, 60Y, 60M, and 60C was measured based on a moving distance of each of the development rollers 51K, 51Y, 51M, and 51C depicted in FIG. 1. When the moving distance of each of the development rollers 51K, 51Y, 51M, and 51C reaches 2,000 m, a second transfer bias is controlled by decreasing a second transfer electric current with constant current control. The moving distance of each of the development rollers 51K, 51Y, 51M, and 51C is configured to reach 2,000 m before the process cartridges form images on 5,000 sheets. When an image is formed on one side of a transfer sheet S, the second transfer electric current decreases from 20 μA to 15 μA. When an image is formed on the other side of the transfer sheet S, the second transfer electric current decreases from 15 μA to 10 μA. Ricoh T6200 sheets were used as transfer sheets S.

Under the above-described condition, the process cartridges were replaced whenever image formation was performed on 5,000 sheets. When image formation was performed on nearly 5,000 sheets, the second transfer bias decreases. Therefore, by the time when image formation is performed on respective numbers of sheets described in FIG. 5, the decreased second transfer electric current may decrease applied biases in total. Accordingly, the degradation degree of the intermediate transfer belt 11 and resultant decreased image quality vary depending on whether or not to decrease the second transfer electric current.

To address this, in the image forming apparatus 100 depicted in FIG. 1, the controller 90 depicted in FIG. 2 controls the second transfer bias based on the degradation degree of each of the image forming stations 60K, 60Y, 60M, and 60C. Thus, the controller 90 serves as a bias controller or a second transfer bias controller.

The degradation degree of each of the image forming stations 60K, 60Y, 60M, and 60C substantively corresponds to a decrease in a charge amount of a developer, that is, toner particles. The charge amount of toner particles decreases due to degradation of the developer as well as degradation of a configuration for charging the developer and various factors for decreasing the charge amount of toner particles forming a toner image on the intermediate transfer belt 11 over time. In the image forming apparatus 100, the degradation degree of each of the image forming stations 60K, 60Y, 60M, and 60C was measured based on the moving distance, in other words, a driving amount of each of rotation bodies included in the image forming stations 60K, 60Y, 60M, and 60C, respectively, that is, the development rollers 51K, 51Y, 51M, and 51C depicted in FIG. 1.

In addition to the development rollers 51K, 51Y, 51M, and 51C, the photoconductive drums 20K, 20Y, 20M, and 20C depicted in FIG. 1 serve as rotation bodies included in the image forming stations 60K, 60Y, 60M, and 60C, respectively. However, the development rollers 51K, 51Y, 51M, and 51C, which contact the developer directly for a long time period, may be preferably used to measure the degradation degree of the developer. Therefore, the degradation degree of each of the image forming stations 60K, 60Y, 60M, and 60C was measured based on the driving amount of each of the development rollers 51K, 51Y, 51M, and 51C, respectively.

Generally as well as in this exemplary embodiment, the development rollers 51K, 51Y, 51M, and 51C rotate with respect to the photoconductive drums 20K, 20Y, 20M, and 20C at a high circumferential speed ratio, respectively. Therefore, the degradation degree of each of the image forming stations 60K, 60Y, 60M, and 60C may be preferably measured based on the driving amount of each of the development rollers 51K, 51Y, 51M, and 51C, respectively, in view of sensitivity.

The driving amount of each of the development rollers 51K, 51Y, 51M, and 51C is measured based on a number of rotations of each of the development rollers 51K, 51Y, 51M, and 51C, respectively. Specifically, a time period for which the controller 90 energizes each of the development roller driving motors 52K, 52Y, 52M, and 52C depicted in FIG. 2 is calculated into the number of rotations of each of the development rollers 51K, 51Y, 51M, and 51C so as to measure the driving amount of each of the development rollers 51K, 51Y, 51M, and 51C, respectively. The RAM 46 depicted in FIG. 2 stores the number of rotations of each of the development rollers 51K, 51Y, 51M, and 51C. Thus, the RAM 46 serves as a memory for storing the number of rotations of each of the development rollers 51K, 51Y, 51M, and 51C or a memory for storing the driving amount of each of the development rollers 51K, 51Y, 51M, and 51C. The RAM 46 includes a region for storing the driving amount of each of the development rollers 51K, 51Y, 51M, and 51C. When gears are provided between the development roller driving motors 52K, 52Y, 52M, and 52C and the development rollers 51K, 51Y, 51M, and 51C, respectively, gear ratios of the gears are multiplied to calculate the driving amount, that is, the number of rotations of each of the development rollers 51K, 51Y, 51M, and 51C.

The controller 90 multiplies the number of rotations by a circumferential length of each of the development rollers 51K, 51Y, 51M, and 51C to calculate the moving distance of each of the development rollers 51K, 51Y, 51M, and 51C.

The calculated moving distance is compared with a predetermined threshold T to determine whether or not the degradation degree of each of the image forming stations 60K, 60Y, 60M, and 60C reaches a degree at which adjustment of the second transfer bias is needed. When the degradation degree of each of the image forming stations 60K, 60Y, 60M, and 60C is measured based on the degradation degree and the decreased charge amount of the developer, the degradation degree of the developer varies depending on a consumption amount of the developer, that is, toner particles, and an environmental condition under which the image forming apparatus 100 is used.

The smaller the consumption amount of the toner particles is, the greater the degradation degree of the toner particles is. Specifically, the toner particles are used in the development devices 50K, 50Y, 50M, and 50C depicted in FIG. 1 for a long time period and thereby repeatedly receive friction caused by the development rollers 51K, 51Y, 51M, and 51C, the photoconductive drums 20K, 20Y, 20M, and 20C, and the like sliding on the toner particles. The developer easily degrades when the image forming apparatus 100 is used under harsh environmental conditions of high temperature and humidity and low temperature and humidity, resulting in a decreased charge amount of the developer. For example, the developer may degrade more quickly under the environmental condition of low temperature and humidity than under the environmental condition of high temperature and humidity.

To detect the degradation degree of each of the image forming stations 60K, 60Y, 60M, and 60C in the image forming apparatus 100, the moving distance of each of the development rollers 51K, 51Y, 51M, and 51C equivalent to the driving amount of each of the image forming stations 60K, 60Y, 60M, and 60C is divided by the consumption amount of toner particles in each of the image forming stations 60K, 60Y, 60M, and 60C. The controller 90 calculates the consumption amount of toner particles based on an image area of a toner image formed by each of the image forming stations 60K, 60Y, 60M, and 60C. Thus, the controller 90 serves as a toner consumption amount calculator. FIG. 6 is a lookup table illustrating examples of the thus calculated degradation degree of each of the image forming stations 60K, 60Y, 60M, and 60C.

In the image forming apparatus 100 depicted in FIG. 1, in order to detect the degradation degree of each of the image forming stations 60K, 60Y, 60M, and 60C depicted in FIG. 1, the moving distance of each of the development rollers 51K, 51Y, 51M, and 51C depicted in FIG. 1 equivalent to the driving amount of each of the image forming stations 60K, 60Y, 60M, and 60C is multiplied by a coefficient corresponding to an environmental condition under which the image forming apparatus 100 is used. As illustrated in FIG. 2, the controller 90 determines the coefficient based on a temperature detected by the temperature sensor 42 and stored in the RAM 46 serving as a temperature memory and a humidity detected by the humidity sensor 43 and stored in the RAM 46 serving as a humidity memory by referring to a table stored in the ROM 45. Thus, the controller 90 serves as an environmental coefficient determination device. The ROM 45 serves as an environmental coefficient memory. FIG. 7 is a lookup table illustrating examples of the thus calculated degradation degree. In FIG. 7, an environmental coefficient NN is 1.0 under a normal temperature of 23 degrees centigrade and a normal humidity of 50 percent, which are appropriate for the image forming apparatus 100 depicted in FIG. 1. An environmental coefficient HH is 1.2 under a high temperature of 32 degrees centigrade and a high humidity of 60 percent, which are higher than the normal temperature and humidity corresponding to the environmental coefficient NN. An environmental coefficient LL is 1.5 under a low temperature of 10 degrees centigrade and a low humidity of 15 percent, which are lower than the normal temperature and humidity corresponding to the environmental coefficient NN.

The image forming apparatus 100 depicted in FIG. 1 uses the moving distance of each of the development rollers 51K, 51Y, 51M, and 51C depicted in FIG. 1, the consumption amount of toner particles, and the environmental coefficient to calculate the degradation degree of each of the image forming stations 60K, 60Y, 60M, and 60C. FIG. 8 is a lookup table illustrating examples of the thus calculated degradation degree. The controller 90 depicted in FIG. 2 serves as a degradation degree detector for detecting the degradation degree of each of the image forming stations 60K, 60Y, 60M, and 60C.

Further, the controller 90 serves as a degradation degree judgment device for judging whether or not to adjust the second transfer bias based on the detected degradation degree by comparison with a predetermined threshold T. Different thresholds T, which are used for judging the degradation degree, are applied to the image forming stations 60K, 60Y, 60M, and 60C depicted in FIG. 1, respectively, because toner images transferred onto the intermediate transfer belt 11 depicted in FIG. 1 in the latter orders are charged up for less times and thereby provide a decreased second transfer property when transferred onto a transfer sheet S, as described above.

For example, a threshold T of 200 is applied to the image forming station 60C provided at an extreme downstream position in the direction of rotation A1 of the intermediate transfer belt 11 depicted in FIG. 1. Thresholds T of 250, 300, and 350, which indicate higher degradation degrees than 200, are applied to the image forming stations 60M, 60Y, and 60K provided at more upstream positions from the image forming station 60C in the direction of rotation A1 of the intermediate transfer belt 11, respectively. Thus, the higher thresholds T are applied to the image forming stations provided at the more upstream positions in the direction of rotation A1 of the intermediate transfer belt 11 by considering the number of charging up.

The thresholds T are used as references by which the controller 90 judges whether or not the degradation degree of each of the image forming stations 60K, 60Y, 60M, and 60C reaches a level at which the second transfer bias needs to be decreased. The ROM 45 serves as a threshold memory for storing the thresholds T.

A toner image transferred onto the intermediate transfer belt 11 at a more downstream position in the direction of rotation A1 of the intermediate transfer belt 11 may easily provide lower image quality. To address this, the controller 90 compares the degradation degree with the threshold T for the image forming stations 60C, 60M, 60Y, and 60K in this order, and adjusts the second transfer bias as needed. The controller 90 retrieves a threshold T corresponding to each of the image forming stations 60C, 60M, 60Y, and 60K from the ROM 45 serving as a threshold memory so as to use the retrieved threshold T.

Figure 9:
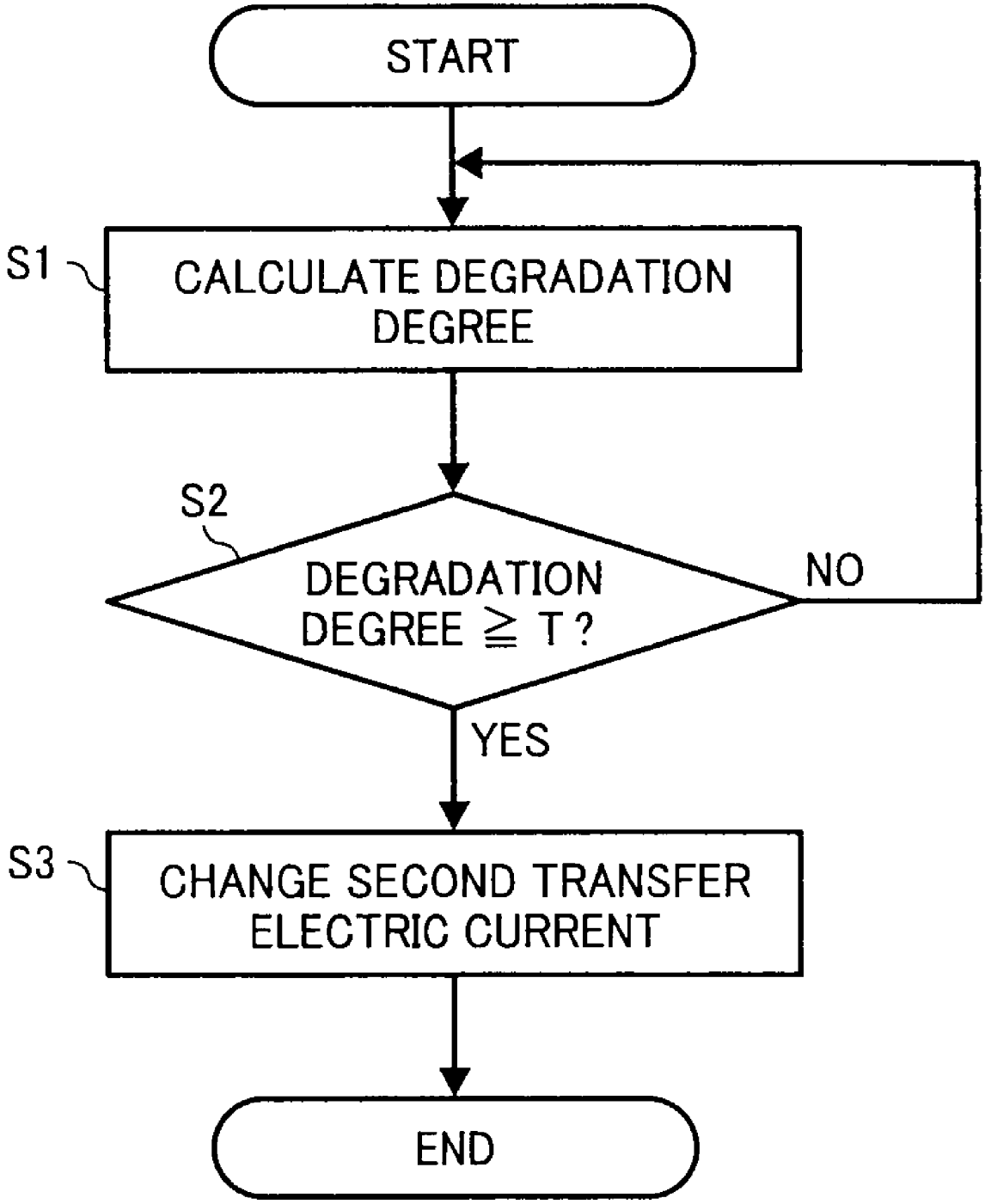
FIG. 9 is a flowchart illustrating a control procedure for adjusting a second transfer bias in the image forming apparatus shown in FIG. 1.

FIG. 9 is a flowchart illustrating a control procedure for adjusting the second transfer bias in the image forming apparatus 100 depicted in FIG. 1. In step S1, the controller 90 depicted in FIG. 2, serving as a degradation degree detector, calculates a degradation degree of the image forming station 60C depicted in FIG. 1 provided at an extreme downstream position in the direction of rotation A1 of the intermediate transfer belt 11 depicted in FIG. 1. In step S2, the controller 90, serving as a degradation degree judgment device, compares the calculated degradation degree of the image forming station 60C with a threshold T of 200 for the image forming station 60C to judge whether or not the calculated degradation degree of the image forming station 60C reaches a level to decrease a second transfer bias. When the controller 90 judges that the calculated degradation degree of the image forming station 60C is the level to decrease the second transfer bias or greater (e.g., when YES is selected in step S2), the controller 90, serving as a second transfer bias controller, changes the second transfer bias (e.g., a second transfer electric current) to a smaller value than a value applied when the degradation degree of the image forming station 60C is smaller than 200, in step S3. For example, when an image is to be formed on one side of a transfer sheet S, the controller 90 decreases the second transfer electric current from a normal value of 20 μA to 12 μA. When an image is to be formed on the other side of the transfer sheet S after a user enters a command to perform duplex printing, the controller 90 decreases the second transfer electric current from a normal value of 15 μA to 10 μA. Thereafter, image formation is performed in this state.

When the degradation degree of the image forming station 60C is smaller than the threshold T of 200 for the image forming station 60C in step S2, the controller 90, serving as a degradation degree detector, calculates a degradation degree of the image forming station 60M depicted in FIG. 1 provided adjacent to the image forming station 60C at an upstream position from the image forming station 60C in the direction of rotation A1 of the intermediate transfer belt 11, in step S1. In step S2, the controller 90, serving as a degradation degree judgment device, compares the calculated degradation degree of the image forming station 60M with a threshold T of 250 for the image forming station 60M to judge whether or not the calculated degradation degree of the image forming station 60M reaches a level to decrease a second transfer bias. When the controller 90 judges that the calculated degradation degree of the image forming station 60M is 250 or greater (e.g., when YES is selected in step S2), the controller 90, serving as a second transfer bias controller, changes the second transfer bias to a smaller value than a value applied when the degradation degree of the image forming station 60M is smaller than 250 in such a manner similar to the above, in step S3. Thereafter, image formation is performed in this state.

When the degradation degree of the image forming station 60M is smaller than the threshold T of 250 for the image forming station 60M in step S2, the controller 90, serving as a degradation degree detector, calculates a degradation degree of the image forming station 60Y depicted in FIG. 1 provided adjacent to the image forming station 60M at an upstream position from the image forming station 60M in the direction of rotation A1 of the intermediate transfer belt 11, in step S1. In step S2, the controller 90, serving as a degradation degree judgment device, compares the calculated degradation degree of the image forming station 60Y with a threshold T of 300 for the image forming station 60Y to judge whether or not the calculated degradation degree of the image forming station 60Y reaches a level to decrease a second transfer bias. When the controller 90 judges that the calculated degradation degree of the image forming station 60Y is 300 or greater (e.g., when YES is selected in step S2), the controller 90, serving as a second transfer bias controller, changes the second transfer bias to a smaller value than a value applied when the degradation degree of the image forming station 60Y is smaller than 300 in such a manner similar to the above, in step S3. Thereafter, image formation is performed in this state.

When the degradation degree of the image forming station 60Y is smaller than the threshold T of 300 for the image forming station 60Y in step S2, the controller 90, serving as a degradation degree detector, calculates a degradation degree of the image forming station 60K depicted in FIG. 1 provided adjacent to the image forming station 60Y at an upstream position from the image forming station 60Y in the direction of rotation A1 of the intermediate transfer belt 11, in step S1. In step S2, the controller 90, serving as a degradation degree judgment device, compares the calculated degradation degree of the image forming station 60K with a threshold T of 350 for the image forming station 60K to judge whether or not the calculated degradation degree of the image forming station 60K reaches a level to decrease a second transfer bias. When the controller 90 judges that the calculated degradation degree of the image forming station 60K is 350 or greater (e.g., when YES is selected in step S2), the controller 90, serving as a second transfer bias controller, changes the second transfer bias to a smaller value than a value applied when the degradation degree of the image forming station 60K is smaller than 350 in such a manner similar to the above, in step S3. Thereafter, image formation is performed in this state.

When the degradation degree of the image forming stations 60K is smaller than the threshold T of 350 for the image forming station 60K in step S2, the controller 90 does not change the second transfer bias and performs an image forming operation.

The above-described control is performed for every image forming operation. The consumption amount of toner particles used for calculating the degradation degree corresponds to the consumption amount of toner particles used until a latest image forming operation. However, the consumption amount of toner particles is reset when the process cartridge including the corresponding image forming station is replaced. The temperature and humidity used for calculating the degradation degree correspond to average temperature and humidity used until a present image forming operation. However, the temperature and humidity are reset when the process cartridge including the corresponding image forming station is replaced.

Figure 10:
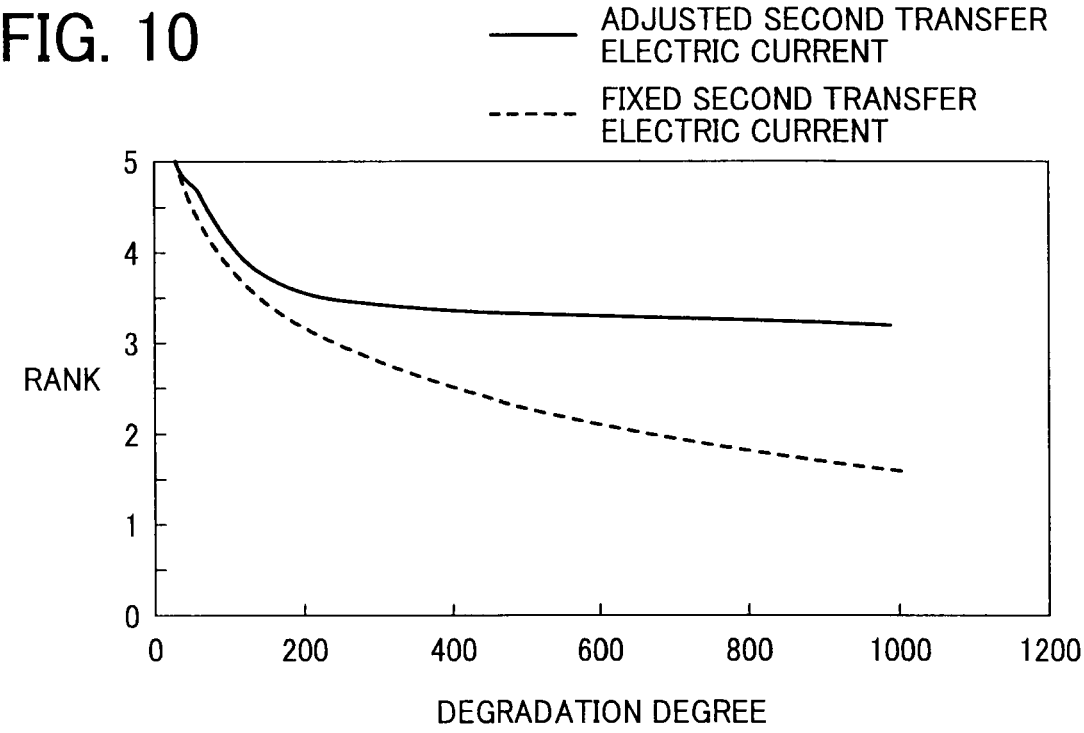
FIG. 10 is a graph illustrating a relation between a degradation degree of an image forming station included in the image forming apparatus shown in FIG. 1 and a rank indicating roughness of a halftone image.

As described above, the controller 90 judges whether or not the degradation degree of each of the image forming stations 60K, 60Y, 60M, and 60C reaches the level to decrease the second transfer bias. When the degradation degree reaches the level to decrease the second transfer bias, the second transfer bias is decreased to provide a result for reducing roughness of a halftone image as illustrated in FIG. 10. FIG. 10 is a graph illustrating a relation between the degradation degree of each of the image forming stations 60K, 60Y, 60M, and 60C depicted in FIG. 1 and a rank indicating roughness of the halftone image.

Figure 11:
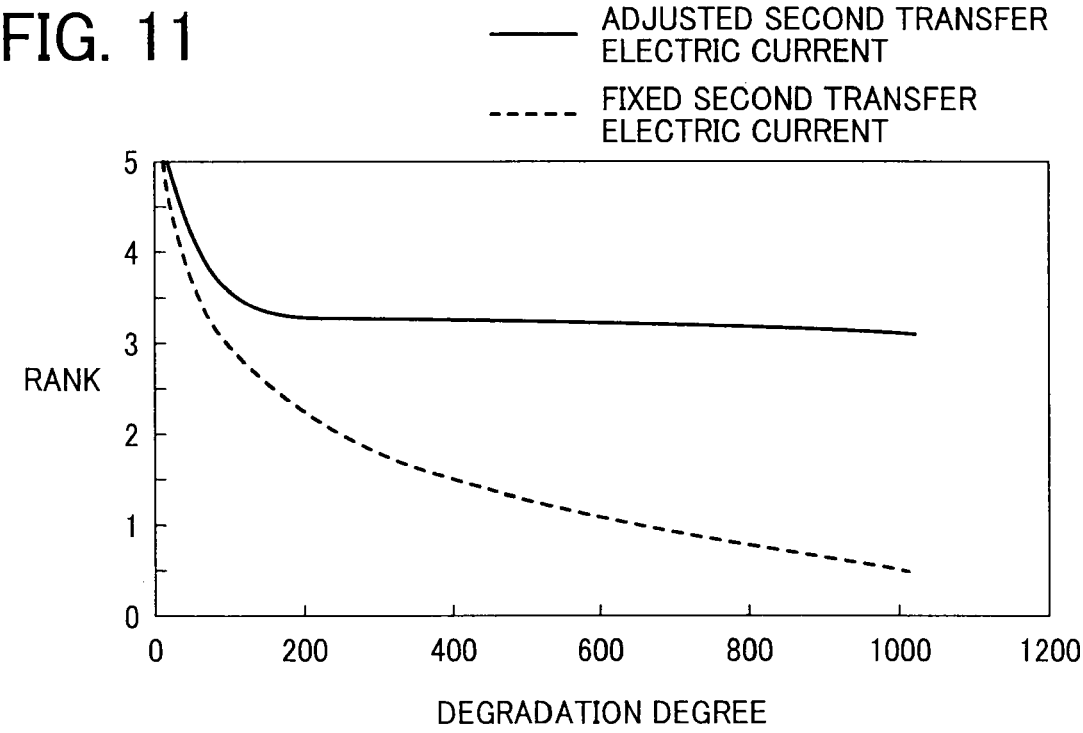
FIG. 11 is another graph illustrating a relation between a degradation degree of an image forming station included in the image forming apparatus shown in FIG. 1 and a rank indicating roughness of a halftone image.

The image forming station 60C provided at an extreme downstream position in the direction of rotation A1 of the intermediate transfer belt 11 depicted in FIG. 1 may easily provide roughness of the halftone image. Therefore, the above-described control may be performed for the image forming station 60C only, so as to simplify the control and to reduce costs. For example, using the threshold T of 100, the second transfer electric current is decreased from a normal value of 20 μA to 15 μA to form an image on one side of a transfer sheet S. The second transfer electric current is decreased from a normal value of 15 μA to 10 μA to form an image on the other side of the transfer sheet S after a user enters a command to perform duplex printing, so as to provide a result for reducing roughness of a halftone image as illustrated in FIG. 11. FIG. 11 is a graph illustrating a relation between the degradation degree of each of the image forming stations 60K, 60Y, 60M, and 60C depicted in FIG. 1 and a rank indicating roughness of the halftone image.

In order to simplify the control and to reduce costs, two thresholds T may be used. Specifically, one threshold T is used for the image forming station 60C provided at an extreme downstream position in the direction of rotation A1 of the intermediate transfer belt 11 depicted in FIG. 1, and another threshold T is used for the image forming stations 60M, 60Y, and 60K provided at positions upstream from the image forming station 60C in the direction of rotation A1 of the intermediate transfer belt 11, respectively. Further, the threshold T is not limited to the above-described values, and various appropriate values may be selected according to image quality.

As described above, according to this exemplary embodiment, the degradation degree of each of the image forming stations 60C, 60M, 60Y, and 60K is compared with the threshold T corresponding to each of the image forming stations 60C, 60M, 60Y, and 60K in this order, that is, from the image forming station 60C provided at an extreme downstream position to the image forming station 60K provided at an extreme upstream position in the direction of rotation A1 of the intermediate transfer belt 11, so as to adjust the second transfer bias. However, when the second transfer bias is adjusted by using the degradation degree of the image forming stations 60K, 60Y, and 60M other than the image forming station 60C provided at the extreme downstream position, superimposing toner images in two colors may form a rough solid image.

Figure 12:
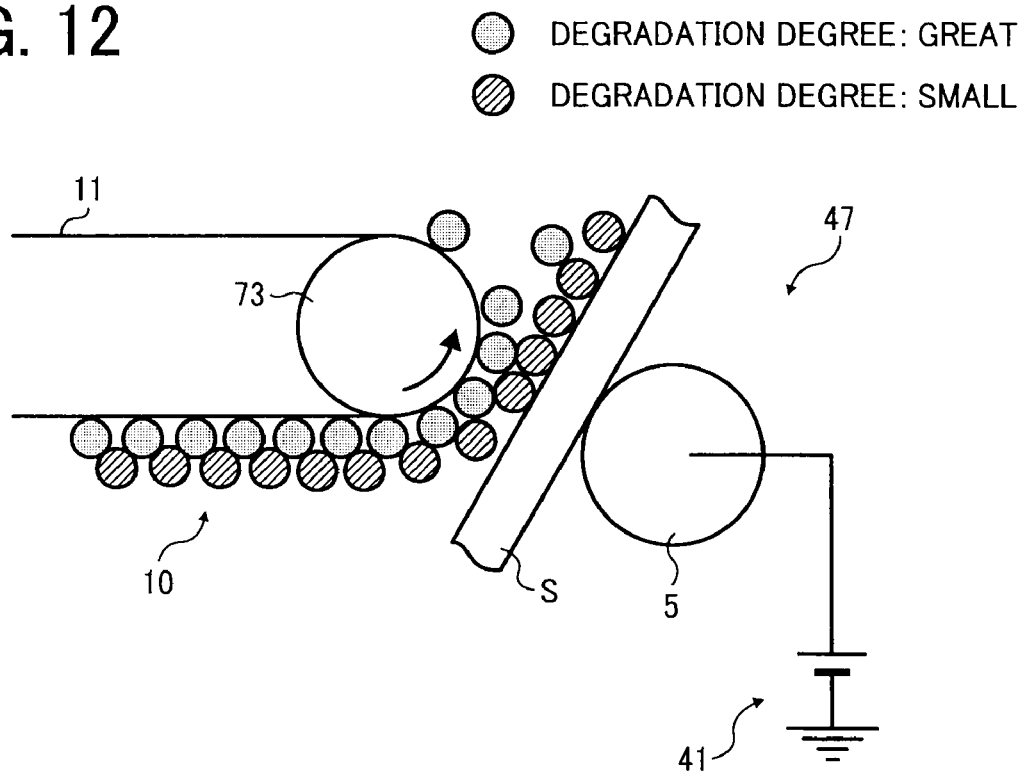
FIG. 12 is a conceptual diagram illustrating superimposed toner images being transferred from an intermediate transfer belt included in the image forming apparatus shown in FIG. 1 onto a transfer sheet.

The following describes a cause of the rough solid image by taking formation of a green toner image for instance. A cyan toner image is superimposed on a yellow toner image to form a green toner image. When a degradation degree of yellow toner particles is greater than a degradation degree of cyan toner particles, the cyan toner image is superimposed on the yellow toner image on the intermediate transfer belt 11 as illustrated in FIG. 12. When a second transfer bias is decreased according to the degradation degree of the yellow toner particles supplied by the image forming station 60Y (depicted in FIG. 1) provided at a position upstream from the image forming station 60C (depicted in FIG. 1) in the direction of rotation A1 of the intermediate transfer belt 11, only the cyan toner particles having the lower degradation degree may be transferred onto a transfer sheet S due to an increased adhesive stress of the yellow toner particles with respect to the intermediate transfer belt 11. Specifically, the yellow toner particles transferred on the intermediate transfer belt 11 are charged up while passing through the image forming stations 60M and 60C (depicted in FIG. 1). However, the yellow toner particles receive an action for pressing the yellow toner particles against the intermediate transfer belt 11.

Figure 13:
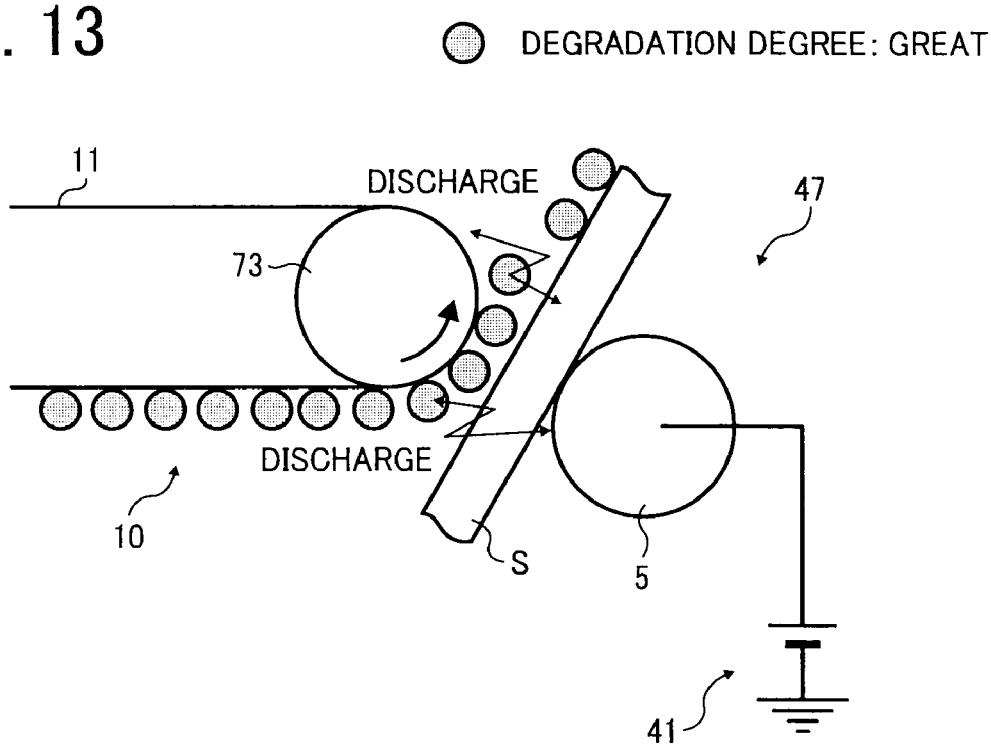
FIG. 13 is a conceptual diagram illustrating a toner image being transferred from an intermediate transfer belt included in the image forming apparatus shown in FIG. 1 onto a transfer sheet.

Accordingly, it is preferable to compare the degradation degree of each of the image forming stations 60C, 60M, 60Y, and 60K with the threshold T corresponding to each of the image forming stations 60C, 60M, 60Y, and 60K in this order, that is, from the image forming station 60C provided at an extreme downstream position to the image forming station 60K provided at an extreme upstream position in the direction of rotation A1 of the intermediate transfer belt 11 according to this exemplary embodiment, so as to adjust the second transfer bias. The above-described control is also effective to reduce roughness of a toner image having a low density like a halftone image formed with toner particles in a single color, as illustrated in FIG. 13.

The present invention has been described above with reference to specific exemplary embodiments. However, the present invention is not limited to the details of the embodiments described above, but various modifications and enhancements are possible.

For example, in order to simplify the control, the controller 90 (depicted in FIG. 2) may detect the degradation degree and judge whether or not the degradation degree reaches a level to adjust a second transfer bias not for all of image forming devices (e.g., the image forming stations 60K, 60Y, 60M, and 60C depicted in FIG. 1) included in the image forming apparatus 100 (depicted in FIG. 1) but only for an image forming device used for a particular image forming operation.

Further, a voltage instead of an electric current may be controlled to control a second transfer bias. The image forming apparatus 100 may use a two-component developer containing toner particles and carriers. Each of the image forming devices may include a sensor (e.g., the temperature sensor 42 and the humidity sensor 43 depicted in FIG. 2) for detecting an environmental condition under which each of the image forming devices is used.

According to the above-described exemplary embodiments, the image forming apparatus 100 functions as a tandem type image forming apparatus. Alternatively, the image forming apparatus 100 may function as an image forming apparatus including a single photoconductive drum, in which toner images in respective colors are sequentially formed on the single photoconductive drum in such a manner that the toner images are superimposed on the photoconductive drum to form a color toner image.

According to the above-described exemplary embodiments, the image forming apparatus 100 functions as a multifunction printer having copier, printer, and facsimile functions. Alternatively, the image forming apparatus 100 may function as a copier, a printer, a facsimile machine, or a multifunction printer having at least one of copier, printer, facsimile, and other functions.

In any type image forming apparatus 100, the image forming apparatus 100 may use a direct transfer method in which toner images in respective colors are directly transferred onto a transfer sheet without using an intermediate transfer member (e.g., the intermediate transfer belt 11 depicted in FIG. 1). For example, toner images formed on a plurality of image carriers (e.g., the photoconductive drums 20K, 20Y, 20M, and 20C depicted in FIG. 1) are directly transferred onto a transfer sheet.

According the above-described exemplary embodiments, an image forming apparatus (e.g., the image forming apparatus 100 depicted in FIG. 1) or an image forming method includes or uses a plurality of image forming devices (e.g., the image forming stations 60K, 60Y, 60M, and 60C depicted in FIG. 1), an intermediate transfer member (e.g., the intermediate transfer belt 11 depicted in FIG. 1), a transfer device (e.g., the second transfer device 47 depicted in FIG. 1), a first degradation degree detector (e.g., the controller 90 depicted in FIG. 2), and a first degradation degree judgment device (e.g., the controller 90 depicted in FIG. 2).

The plurality of image forming devices forms respective toner images. The intermediate transfer member rotates to receive the toner images transferred from the plurality of image forming devices. The transfer device applies a bias to transfer the toner images from the intermediate transfer member onto a transfer sheet. The first degradation degree detector detects a degradation degree of one of the plurality of image forming devices provided at an extreme downstream position in a direction of rotation of the intermediate transfer member. The first degradation degree judgment device judges whether or not the degradation degree of the extreme downstream image forming device detected by the first degradation degree detector reaches a first level of deterioration. When the first degradation degree judgment device judges that the degradation degree of the extreme downstream image forming device reaches the first level, a bias to be applied by the transfer device is adjusted to a value lower than a bias to be applied when the first degradation degree judgment device judges that the degradation degree of the extreme downstream image forming device does not reach the first level.

Accordingly, the toner images can be properly transferred from the intermediate transfer member onto the transfer sheet, resulting in formation of a high-quality image. Further, the lower bias applied to the intermediate transfer member can suppress degradation of the intermediate transfer member, resulting in a long life of the intermediate transfer member.

The first degradation degree detector detects the degradation degree of the extreme downstream image forming device based on a driving amount of the extreme downstream image forming device. Alternatively, the first degradation degree detector may detect the degradation degree of the extreme downstream image forming device based on a value obtained by dividing the driving amount of the extreme downstream image forming device by a consumption amount of toner particles consumed by the extreme downstream image forming device. Yet alternatively, the first degradation degree detector may detect the degradation degree of the extreme downstream image forming device based on an environmental condition under which the extreme downstream image forming device is used.

Accordingly, the first degradation degree detector can detect the degradation degree of the extreme downstream image forming device precisely, resulting in formation of a high-quality image. Further, the lower bias applied to the intermediate transfer member can suppress degradation of the intermediate transfer member, resulting in a long life of the intermediate transfer member.

The image forming apparatus further includes a second degradation degree detector and a second degradation degree judgment device (e.g., the controller 90 depicted in FIG. 2). When the degradation degree of the extreme downstream image forming device detected by the first degradation degree detector does not reach the first level, the second degradation degree detector detects a degradation degree of at least one other one of the plurality of image forming devices provided at an upstream position upstream from the extreme downstream image forming device, that is, the image forming device provided at the extreme downstream position in the direction of rotation of the intermediate transfer member. The second degradation degree judgment device judges whether or not the degradation degree of the at least one other one of the plurality of image forming devices detected by the second degradation degree detector reaches a second level higher than the first level. The second degradation degree judgment device performs judgment by using as the second level at least one level for the at least one other one of the plurality of image forming devices. The level for the at least one other one of the plurality of image forming devices increases sequentially from the first level from one (e.g., the image forming station 60M depicted in FIG. 1) of the plurality of image forming devices provided upstream from the extreme downstream image forming device (e.g., the image forming station 60C depicted in FIG. 1) to another image forming device (e.g., the image forming station 60K depicted in FIG. 1) provided at an extreme upstream position in the direction of rotation of the intermediate transfer member. When the second judgment device judges that the degradation degree of the at least one other one of the plurality of image forming devices reaches the second level, a bias to be applied by the transfer device is adjusted to a value lower than a value to be applied when the first degradation degree judgment device judges that the degradation degree of the extreme downstream image forming device does not reach the first level and the second degradation degree judgment device judges that the degradation degree of the at least one other one of the plurality of image forming devices does not reach the second level.

Namely, the degradation degree of the image forming device other than the extreme downstream image forming device is also used to control the bias. Accordingly, the toner images can be properly transferred from the intermediate transfer member onto the transfer sheet, resulting in formation of a high-quality image. Further, the lower bias applied to the intermediate transfer member can suppress degradation of the intermediate transfer member, resulting in a long life of the intermediate transfer member.

Effects provided by the present invention are not limited to the effects of the embodiments described above.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. An image forming apparatus, comprising:

a plurality of image forming devices configured to form respective toner images;

a rotating intermediate transfer member configured to receive the toner images from the plurality of image forming devices;

a transfer device configured to apply a bias to the intermediate transfer member to transfer the toner images formed on the intermediate transfer member onto a transfer sheet;

a first degradation degree detector configured to detect a first degradation degree of one of the plurality of image forming devices provided at an extreme downstream position in a direction of rotation of the intermediate transfer member;

a first degradation degree judgment device configured to judge whether or not the first degradation degree of the extreme downstream image forming device detected by the first degradation degree detector reaches a first level of deterioration; and a bias controller configured to decrease the bias to be applied by the transfer device to a value smaller than a value of the bias to be applied when the first degradation degree judgment device judges that the first degradation degree of the extreme downstream image forming device detected by the first degradation degree detector does not reach the first level, when the first degradation degree judgment device judges that the first degradation degree of the extreme downstream image forming device detected by the first degradation degree detector reaches the first level.

2. The image forming apparatus according to claim 1, wherein the first degradation degree detector detects the first degradation degree of the extreme downstream image forming device based on a driving amount of the extreme downstream image forming device.

3. The image forming apparatus according to claim 1, wherein the first degradation degree detector detects the first degradation degree of the extreme downstream image forming device based on a value obtained by dividing a driving amount of the extreme downstream image forming device by a consumption amount of toner particles consumed by the extreme downstream image forming device.

4. The image forming apparatus according to claim 1, wherein the first degradation degree detector detects the first degradation degree of the extreme downstream image forming device based on an environmental condition under which the extreme downstream image forming device is used.

5. The image forming apparatus according to claim 1, further comprising:

a second degradation degree detector configured to detect a second degradation degree of at least one other one of the plurality of image forming devices provided upstream from the extreme downstream image forming device in the direction of rotation of the intermediate transfer member when the first degradation degree of the extreme downstream image forming device detected by the first degradation degree detector does not reach the first level; and a second degradation degree judgment device configured to judge whether or not the second degradation degree of the at least one other one of the plurality of image forming devices detected by the second degradation degree detector reaches a second level higher than the first level, wherein the second degradation degree judgment device performs judgment by using., as the second level, at least one level for the at least one other one of the plurality of image forming devices, the level for the at least one other one of the plurality of image forming devices increasing sequentially from the first level from one of the plurality of image forming devices provided upstream from the extreme downstream image forming device to another image forming device provided at an extreme upstream position in the direction of rotation of the intermediate transfer member, and wherein the bias controller decreases the bias to be applied by the transfer device to a value smaller than a value of the bias to be applied, when the first degradation degree judgment device judges that the first degradation degree of the extreme downstream image forming device detected by the first degradation degree detector does not reach the first level and the second degradation degree judgment device judges that the second degradation degree of the at least one other one of the plurality of image forming devices detected by the second degradation degree detector does not reach the second level, when the second degradation degree judgment device judges that the second degradation degree of the at least one other one of the plurality of image forming devices detected by the second degradation degree detector reaches the second level.

6. The image forming apparatus of claim 1, further comprising:

a second degradation degree detector configured to detect a second degradation degree of at least one other one of the plurality of image forming devices provided upstream from the extreme downstream image forming device in the direction of rotation of the intermediate transfer member only when the first degradation degree of the extreme downstream image forming device detected by the first degradation degree detector does not reach the first level.

7. An image forming method, comprising:

forming respective toner images with a plurality of image forming devices;

transferring the toner images formed by the plurality of image forming devices onto a rotating intermediate transfer member;

detecting a first degradation degree of one of the plurality of image forming devices provided at an extreme downstream position in a direction of rotation of the intermediate transfer member with a first degradation degree detector;

judging whether or not the first degradation degree of the extreme downstream image forming device detected by the first degradation degree detector reaches a first level of deterioration with a first degradation degree judgment device;

decreasing a bias to be applied by a transfer device to a value smaller than a value of the bias to be applied when the first degradation degree judgment device judges that the first degradation degree of the extreme downstream image forming device detected by the first degradation degree detector does not reach the first level, when the first degradation degree judgment device judges that the first degradation degree of the extreme downstream image forming device detected by the first degradation degree detector reaches the first level; and applying the decreased bias to the intermediate transfer member with the transfer device to transfer the toner images formed on the intermediate transfer member onto a transfer sheet.

8. The image forming method of claim 7, wherein the detecting step comprises detecting the first degradation degree of the extreme downstream image forming device based on a value obtained by dividing a driving amount of the extreme downstream image forming device by a consumption amount of toner particles consumed by the extreme downstream image forming device.

9. The image forming method of claim 7, wherein the detecting step comprises detecting the first degradation degree of the extreme downstream image forming device based on an environmental condition under which the extreme downstream image forming device is used.

* * * * *